US008019038B2

(12) United States Patent
Evans et al.

(10) Patent No.: US 8,019,038 B2
(45) Date of Patent: Sep. 13, 2011

(54) STEAM GENERATOR NOZZLE DAM AND METHOD FOR INSTALLING AND REMOVING STEAM GENERATOR NOZZLE DAM

(75) Inventors: Cliff Evans, Newtown, CT (US); Mark W. Dalton, Woodbury, CT (US)

(73) Assignee: Advanced Engineered Products Incorporated, Waterford, CT (US)

( * ) Notice: Subject to any disclaimer, the term of this patent is extended or adjusted under 35 U.S.C. 154(b) by 558 days.

(21) Appl. No.: 11/985,851

(22) Filed: Nov. 16, 2007

(65) Prior Publication Data

US 2008/0179042 A1 Jul. 31, 2008

Related U.S. Application Data

(60) Provisional application No. 60/873,726, filed on Dec. 7, 2006, provisional application No. 60/860,538, filed on Nov. 21, 2006.

(51) Int. Cl.
*G21C 13/00* (2006.01)
*G21C 19/00* (2006.01)
*G21F 5/00* (2006.01)

(52) U.S. Cl. ..... 376/204; 376/272; 250/206.1; 250/507.1

(58) Field of Classification Search ..... 376/204, 376/272; 250/506.1, 507.1
See application file for complete search history.

(56) References Cited

U.S. PATENT DOCUMENTS

| | | | | | |
|---|---|---|---|---|---|
| 3,684,116 | A | * | 8/1972 | Duffy | 215/211 |
| 4,160,612 | A | * | 7/1979 | Britton et al. | 405/227 |
| 4,482,076 | A | * | 11/1984 | Wentzell | 220/232 |
| 4,667,701 | A | * | 5/1987 | Evans et al. | 138/93 |
| 4,957,215 | A | | 9/1990 | Evans et al. | |
| 5,167,905 | A | * | 12/1992 | Mentz et al. | 376/204 |
| 5,171,514 | A | * | 12/1992 | Veronesi et al. | 376/204 |

* cited by examiner

*Primary Examiner* — Rick Palabrica
*Assistant Examiner* — Erin M Leach
(74) *Attorney, Agent, or Firm* — Lipsitz & McAllister, LLC

(57) ABSTRACT

The present invention includes an apparatus for watertight sealing of a steam generator nozzle and methods for installing the apparatus. The apparatus comprises a nozzle dam, a nozzle dam attachment ring, and a seal. The attachment ring is provided in an interior of the nozzle and has a plurality of retaining tabs and a nozzle dam landing. The nozzle dam is adapted for insertion into the attachment ring and abutment against the nozzle dam landing. The nozzle dam has a plurality of radial protrusions adapted to interlock with the retaining tabs for fixing the nozzle dam in the attachment ring upon rotation of the nozzle dam in the attachment ring. The seal covers at least one side of the nozzle dam for effecting a seal between the nozzle dam and the attachment ring. The present invention also provides methods and apparatus for the pressurization and control of nozzle dam seals.

18 Claims, 21 Drawing Sheets

STEAM GENERATOR NOZZLE DAM AND METHOD FOR INSTALLING AND REMOVING STEAM GENERATOR NOZZLE DAM

This application claims the benefit of U.S. provisional patent application No. 60/873,726 filed on Dec. 7, 2006 and U.S. provisional patent application No. 60/860,538 filed on Nov. 21, 2006, each of which is incorporated herein by reference in their entirety and for all purposes.

BACKGROUND OF THE INVENTION

The present invention relates generally to the field of steam generators used in nuclear power plants. More specifically, the present invention relates to improved nozzle dams for hot and cold legs of a steam generator, as well as methods for installing and removing such improved nozzle dams. The present invention also includes methods and apparatus for the pressurization and control of steam generator nozzle dam seals.

Nuclear power plants are routinely shut down for refueling, maintenance, inspection, and testing. FIG. 1 shows a simplified diagram of a typical nuclear power plant 10 which includes a steam generator 12, a reactor pressure vessel 14 holding a reactor core 16 in a core support barrel 18, and a refueling pool 20. When refueling a nuclear power plant or servicing the reactor core 16, the reactor pressure vessel 14 and refueling pool 20 are flooded with water. However, when the reactor pressure vessel 14 and refueling pool 20 are flooded, water will typically enter the steam generator 12 preventing maintenance, inspection and testing of the steam generator 12 during refueling or servicing of the reactor core 16. In order to simultaneously service both the reactor core 16 and the steam generator 12, some form of temporary seal must be installed in the piping 22 connecting the reactor pressure vessel 14 with the generator 12 in order to isolate the reactor core 16 and refueling pool 20 from the steam generator 12, thus permitting simultaneous testing and inspection of the generator components. This seal is achieved by installing what is known in the industry as a "nozzle dam" in the nozzles of the steam generator primary head. A cutaway view of the nozzle 24 of the steam generator 12 is shown in FIG. 1A. The nozzle dam 26 is designed to be carried through a small manway 28 in the generator head and assembled by hand. As the nozzle dam installer is subject to radiation exposure inside the steam generator 12, the nozzle dam 26 must be installed as quickly as possible in order to minimize the radiation exposure. The nozzle dam 26 also must effect a reliable water-tight seal able to withstand high water pressures without compromising the structural integrity of the nozzle wall or steam generator wall.

FIG. 2 shows a cutaway view of a typical prior art nozzle dam 26. Such nozzle dams 26 used to seal the nozzles 24 of nuclear power plant steam generators typically use aluminum structures supporting a rubber diaphragm 30 with pneumatic seals (e.g., a dry seal 32, a wet seal 36, and an annulus 34 between the wet seal 36 and dry seal 32), as shown in FIG. 2. Two variations of nozzle dam attachment are currently in use. FIGS. 3 and 3A show cutaway views which depict the nozzle dam 26 attached to the nozzle 24 utilizing radial pins 38 interfacing with holes 40 on the interior of the steam generator nozzle 24 or interfacing with welded hold-down rings. As shown in FIG. 4, another common attachment method uses a flange 42 at the top of the nozzle dam 26 bolted to a ring 44 that has been welded to the steam generator bowl at the junction of the nozzle 24 and the body of the steam generator 12. The inside diameter of the welded ring 44 may also serve as a sealing surface for the pneumatic seals.

Other examples of prior art nozzle dams are described in U.S. Pat. No. 4,667,701 and U.S. Pat. No. 4,957,215.

Such prior art nozzle dam designs were designed as retrofits for pre-existing steam generators and were thus constrained by the pre-existing design of the steam generator nozzles. Accordingly, these prior art nozzle dams were limited in terms of placement position in the nozzle, attachment points and supports, unknown sealing surfaces of the nozzles, and limited manway openings. Further, such prior art nozzle dam installation technicians are subject to radiation exposure level limitations. These constraints resulted in nozzle dams that were large in size, heavy in weight, difficult and time consuming to install and remove, had unknown sealing surfaces, expensive to manufacture, comprised of multiple moving components such as structural bolts, pins or other locking mechanisms each of which had the potential for failure, and not readily adapted for remote installation or removal.

With the advent of new nuclear power plant designs, such as Westinghouse's new AP1000 nuclear power plant design and the supply of new replacement stream generators, an opportunity exists for overcoming most, if not all, the limitations of prior art nozzle dam designs by working with the steam generator manufacturer to ensure standardized steam generator nozzles with uniform sealing surfaces.

It would therefore be advantageous to provide a nozzle dam design for steam generators of newly designed nuclear power plants and for replacement steam generators, which when compared to the prior art nozzle dams are lighter in weight, smaller in size, simpler and quicker to install, have a known sealing surface, are economical to manufacture, are designed without multiple moving components such as bolts, pins, or other locking mechanisms having the potential for failure, minimize radiation exposure, and are adaptive to remote installation and removal.

The methods and apparatus of the present invention provide the foregoing and other advantages.

SUMMARY OF THE INVENTION

The present invention relates to nozzle dams for nuclear power plant steam generators, and methods for installing and removing nozzle dams.

The present invention includes an apparatus for watertight sealing of a steam generator nozzle. In one example embodiment, the apparatus comprises a nozzle dam, a nozzle dam attachment ring designed to accept the nozzle dam, and a seal. The attachment ring is provided in an interior of the nozzle and has a plurality of retaining tabs and a nozzle dam landing. The nozzle dam is adapted for insertion into the attachment ring and abutment against the nozzle dam landing. The nozzle dam has a plurality of radial protrusions adapted to interlock with the retaining tabs for fixing the nozzle dam in the attachment ring upon rotation of the nozzle dam in the attachment ring. The seal covers at least one side of the nozzle dam for effecting a watertight seal between the nozzle dam and the attachment ring.

In a further example embodiment, the nozzle dam and seal form a nozzle dam assembly. The nozzle dam may be disc-shaped and divided into two disc segments. The seal may form a hinge connecting the two disc segments, enabling the nozzle dam assembly to be folded in half.

A center locking mechanism may be provided for locking the two disc segments together in an unfolded state of the nozzle dam. Further, a rotation limiting mechanism may be provided on the nozzle dam to prevent over-rotation of the nozzle dam assembly in the attachment ring. In addition, a locking mechanism may be provided for locking the nozzle dam into the attachment ring. The locking mechanism may comprise a locking pin, a locking tab, or the like.

In another example embodiment, cladding may be fitted into the interior of the nozzle and the attachment ring may be fixed in the cladding (e.g., by welding). Alternatively, the attachment ring may be machined from cladding provided in the interior of the nozzle.

The seal may extend over one side of the nozzle dam at over at least a portion of the nozzle dam edge. Alternatively, the seal may extend over one side of the nozzle dam and beyond the edges of the nozzle dam.

In one example embodiment, the seal may comprise an inflatable seal. The seal may be pressurized remotely after interlocking of the nozzle dam in the attachment ring. A computerized pressurization control and monitoring station may be provided for controlling and monitoring the remote pressurization of the seal.

The seal may comprise a segmented seal having a diaphragm extending over one side of the nozzle dam and at least one pneumatic seal extending around a circumference of the nozzle dam. For example, two pneumatic seals may be provided with an annulus arranged therebetween. The segments of the seal may be adapted to be pressurized and monitored independently by the pressurization control and monitoring station. The diaphragm may comprise a mechanical seal which is activated by the flow of water.

The present invention is also directed towards a nozzle dam assembly for a nozzle of a steam generator. In one example embodiment, the nozzle dam assembly may comprise a disc-shaped nozzle dam which is divided into two segments and a seal covering at least one side of the nozzle dam. The seal may form a hinge connecting the two disc segments and enabling the nozzle dam assembly to be folded in half. A plurality of radial protrusions may extend from the nozzle dam which are adapted to interlock with corresponding retaining tabs on an attachment ring in an interior of the nozzle upon rotation of the nozzle dam assembly in the attachment ring. The nozzle dam assembly of the present invention may also include additional features of the nozzle dam and seal mentioned above.

The present invention is also directed towards an attachment ring for accepting a nozzle dam assembly for a nozzle of a steam generator. In one example embodiment, the attachment ring comprises a plurality of retaining tabs and a plurality of receiving slots positioned between the retaining tabs for accepting radial protrusions of a nozzle dam of the nozzle dam assembly. A nozzle dam landing is provided for supporting the nozzle dam assembly. The retaining tabs interlock with the radial protrusions of the nozzle dam upon rotation of the nozzle dam assembly once the nozzle dam assembly is positioned in the attachment ring abutting the nozzle dam landing.

The present invention also includes methods for installing a nozzle dam assembly into an interior of a steam generator nozzle. In order to install the nozzle dam prior to maintenance of the steam generator, the nozzle dam assembly is folded in half and passed through the manway to an installer who has climbed into the steam generator through the manway after removal of a manway cover. The nozzle dam assembly comprises a disc-shaped nozzle dam and a seal, the nozzle dam being divided into two disc segments with the seal forming a hinge connecting the two disc segments. The nozzle dam assembly can then be unfolded into an open position. The nozzle dam assembly can be locked in the open position with a center locking mechanism locking the two disc segments together. The nozzle dam assembly can then be inserted into an attachment ring in the nozzle interior. The nozzle dam assembly can then be rotated so that radial protrusions extending from the nozzle dam interlock with corresponding retaining tabs on the attachment ring. The nozzle dam assembly can then be secured to the attachment ring in an interlocked position using a locking mechanism, which is adapted to prevent the nozzle dam assembly from rotating in either direction. Once the locking mechanism is set, the installer exits the manway. The inflatable seal can then be pressurized to effect a watertight seal between the attachment ring and the nozzle dam.

Removal of the nozzle dam is simply the reverse of the installation procedure.

The time required for installation or removal of the nozzle dam assembly is estimated at approximately 30 seconds, which is considerably faster than prior art nozzle dams that require the manipulation of multiple bolts or pins during installation and removal.

The present invention also provides methods and apparatus for the pressurization and control of steam generator nozzle dam seals.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
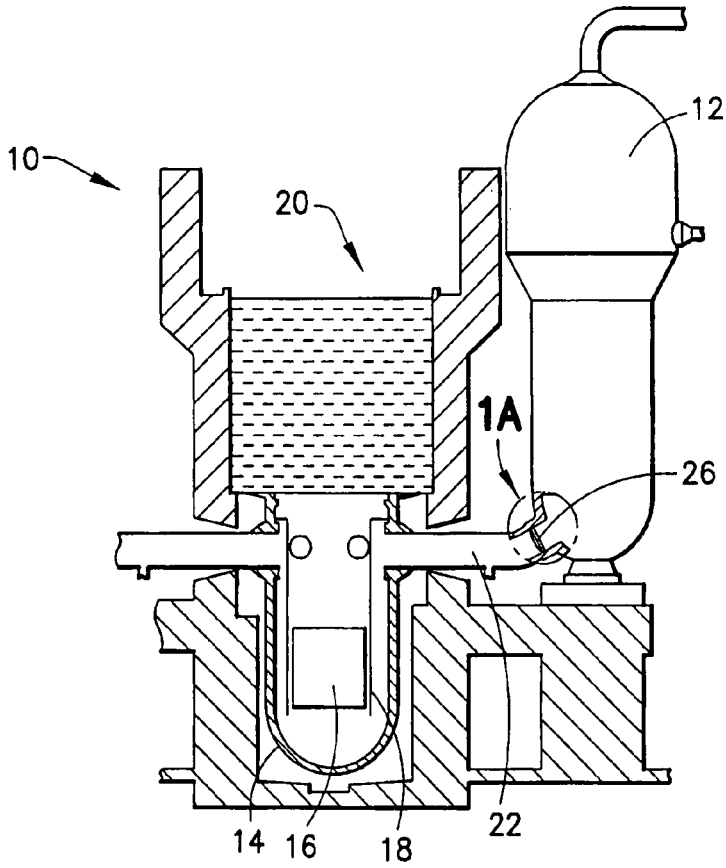
FIG. 1 PRIOR ART
FIG. 1 shows a general overview of a prior art nuclear power plant during flooding of the reactor vessel and the refueling pool.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to improved nozzle dams for hot and cold legs of a steam generator, as well as methods for installing and removing such an improved nozzle dams.

As shown in FIGS. 5-19B, the present invention includes various example aspects and embodiments of a nozzle dam system that includes a nozzle dam assembly and a nozzle dam attachment ring designed to accept the nozzle dam assembly. In the example embodiment shown in FIGS. 6A-6C, the nozzle dam assembly 60 comprises a nozzle dam 62 and an inflatable seal 64. The nozzle dam 62 is disk shaped and consists of two segments 62*a* and 62*b* joined by the seal 64. The seal 64 may extend over one side of the nozzle dam 60 and at least a portion of the nozzle dam edge. Optionally the inflatable seal 64 may extend over one side of the nozzle dam 62 beyond the edges of the nozzle dam 62.

The nozzle dam assembly 60 may be folded in half (i.e., along joint line 63), with the inflatable seal 64 acting as a hinge connecting the two segments 62*a* and 62*b*.

Figure 5:
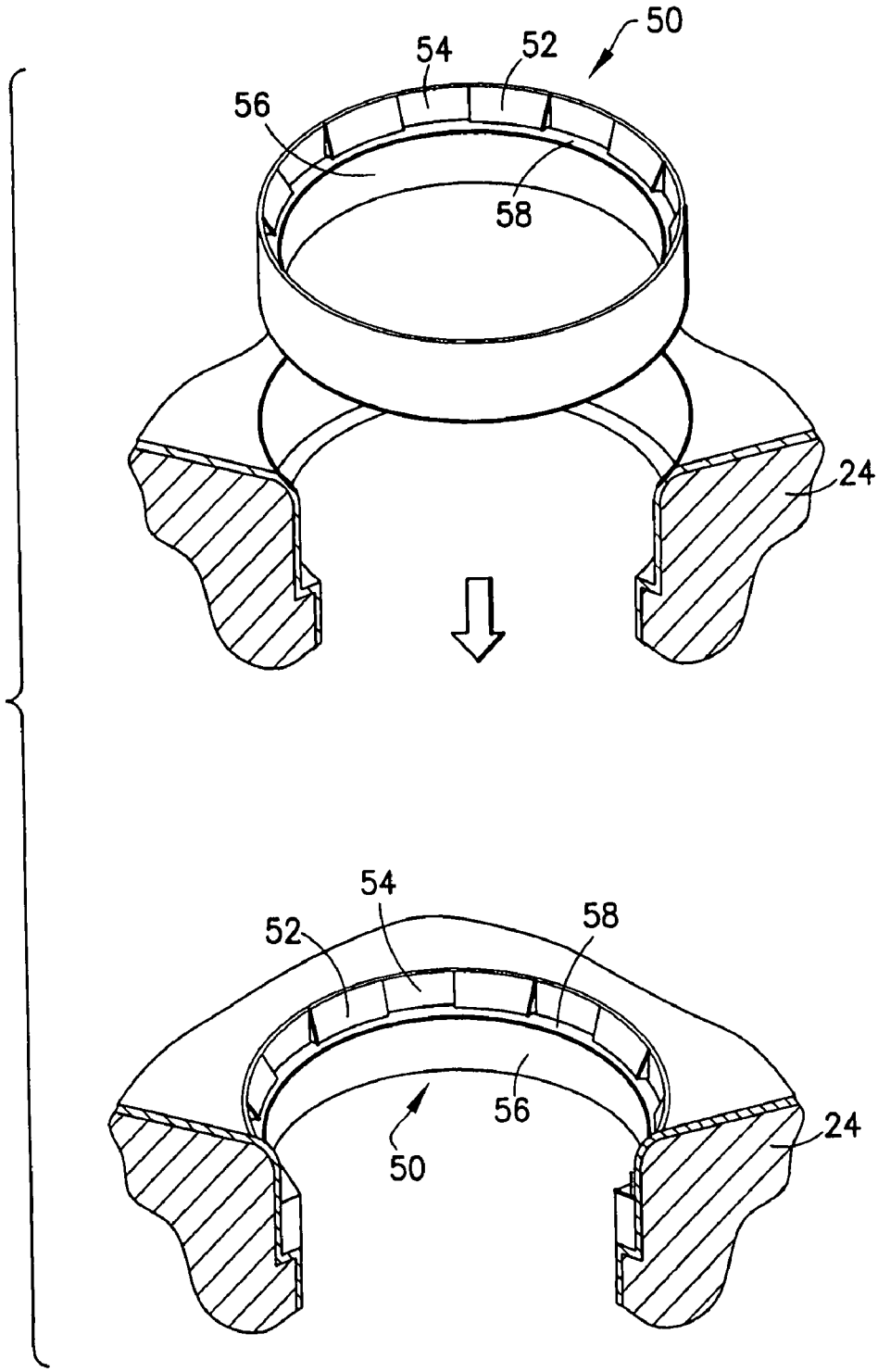
FIG. 5 shows an example embodiment of a nozzle dam attachment ring in accordance with the present invention.
Figure 6A:
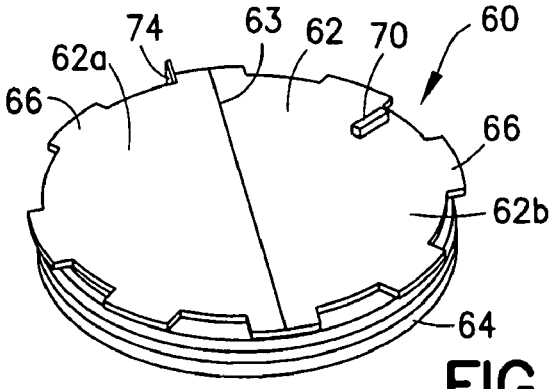
FIG. 6A shows an example embodiment of a nozzle dam in accordance with the present invention.
Figure 14B:
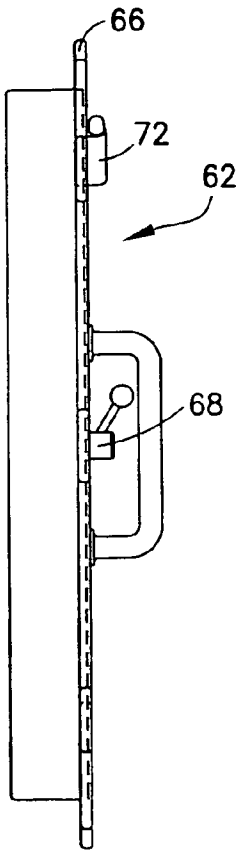
FIG. 14B shows a side view of an example embodiment of a nozzle dam in accordance with the present invention.
Figure 14A:
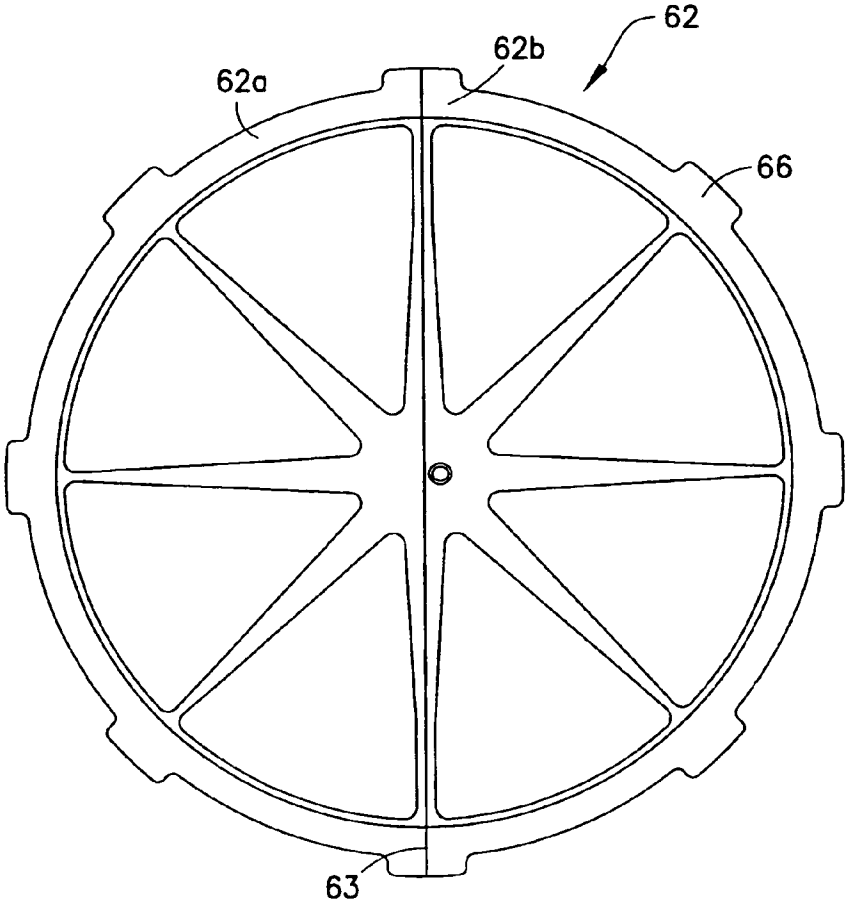
FIG. 14A shows a bottom view of an example embodiment of a nozzle dam in accordance with the present invention.
Figure 14D:
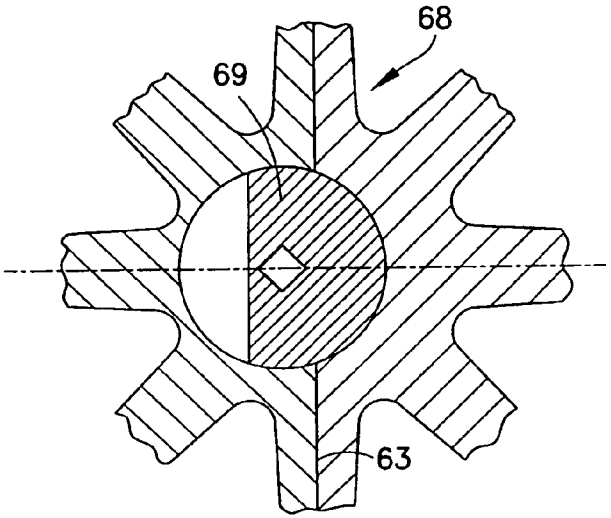
FIG. 14D shows a cross-section of an example embodiment of a center locking mechanism of the example nozzle dam of FIG. 14C.
Figure 14E:
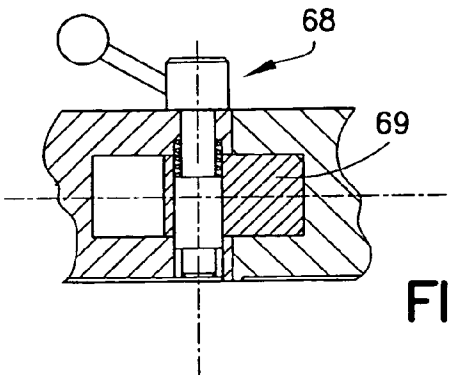
FIG. 14E shows a cutaway view of a the example center locking mechanism shown in FIG. 14D.
Figure 14C:
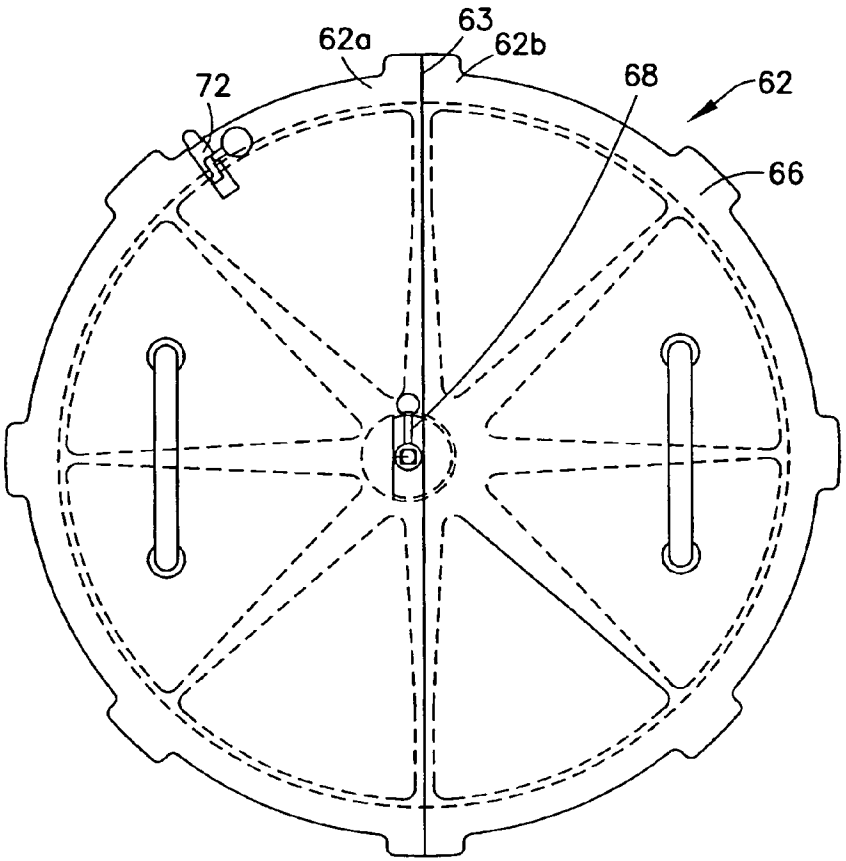
FIG. 14C shows a top view of an example embodiment of a nozzle dam in accordance with the present invention.
Figure 15A:
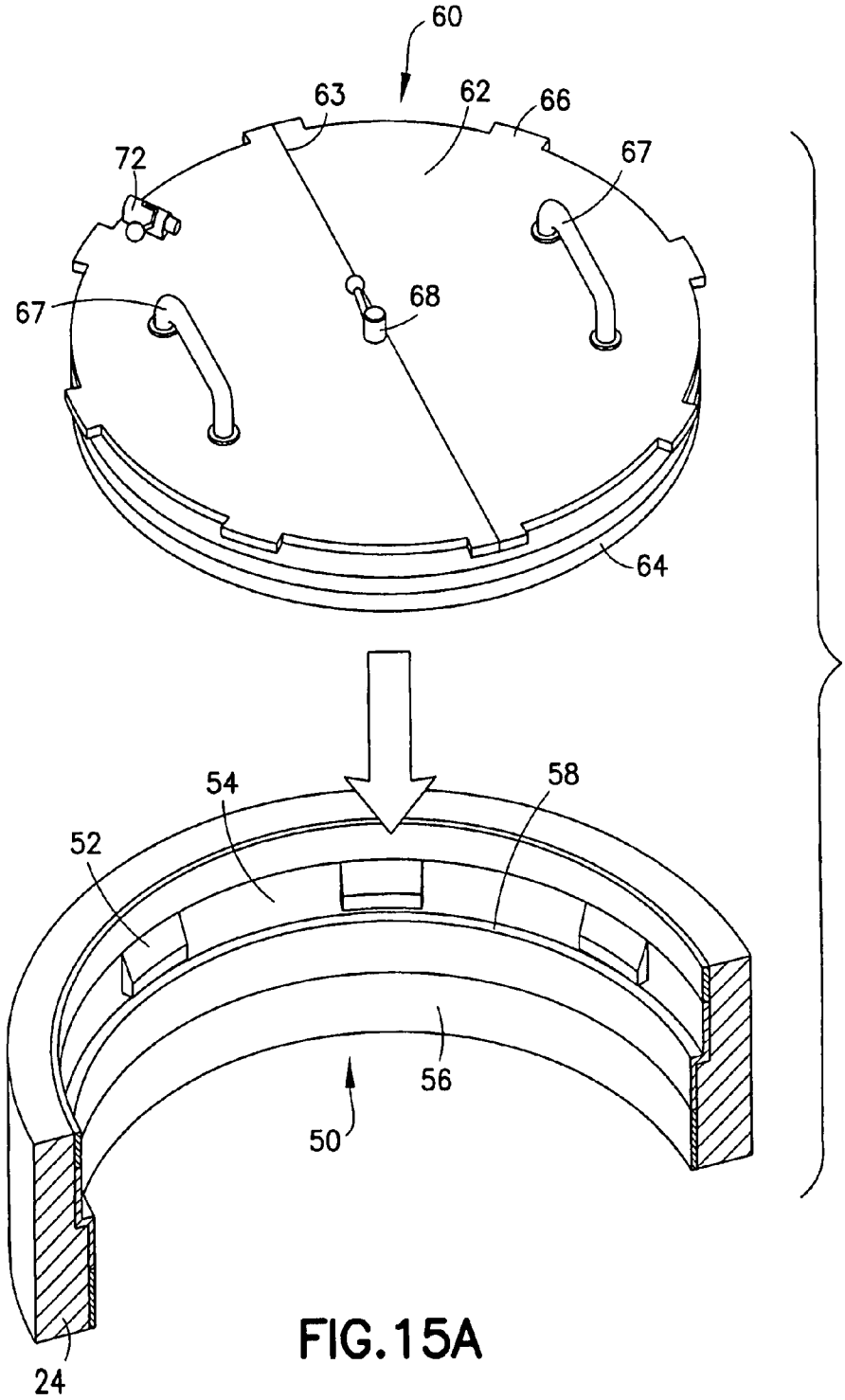
FIG. 15A shows cutaway views of an example embodiment of an attachment ring and a perspective view of an example embodiment of a nozzle dam in accordance with the present invention.
Figure 15B:
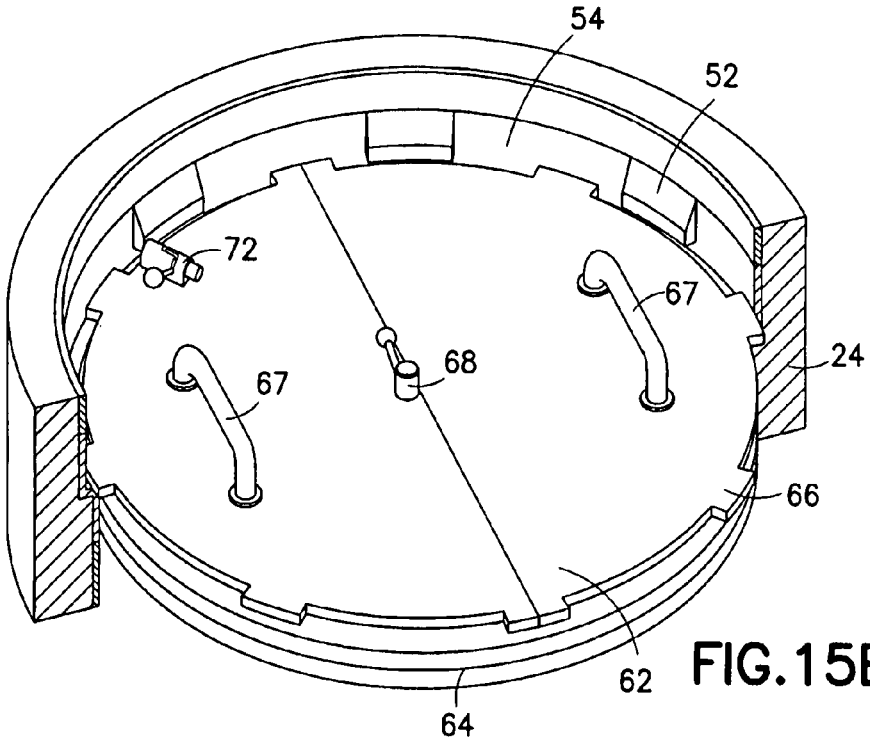
FIG. 15B shows a cutaway view of the example nozzle dam of FIG. 15A after insertion into the example attachment ring of FIG. 15A.

As shown in FIGS. 6A and 14C, the nozzle dam 62 may include a plurality of equally spaced-apart radial protrusions 66 extending from the disk segments 62*a* and 62*b*. These radial protrusions 66 may be used to secure the nozzle dam 62 to the nozzle dam attachment ring 50 (FIG. 5).

A center locking unit 68 may be provided for locking the two segments 62*a* and 62*b* of the nozzle dam together, as shown in FIGS. 14A-14E. FIG. 14D shows a cross-section of the center locking unit 68 in a locked in position (e.g., with a locking disc 69 rotated to extend across the joint line 63) preventing folding of the two segments 62*a* and 62*b*. FIG. 14E shows a cutaway view of the center locking mechanism 68.

Figure 6B:
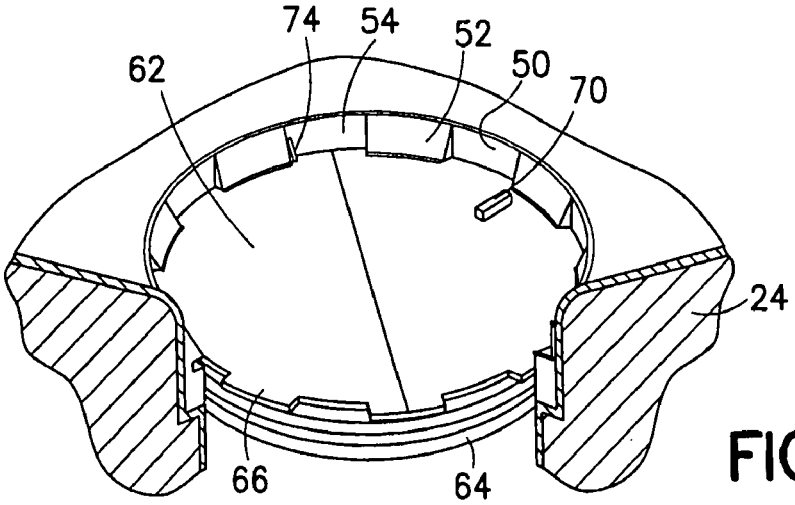
FIG. 6B shows the example nozzle dam of FIG. 6A inserted in the example attachment ring of FIG. 5.
Figure 6C:
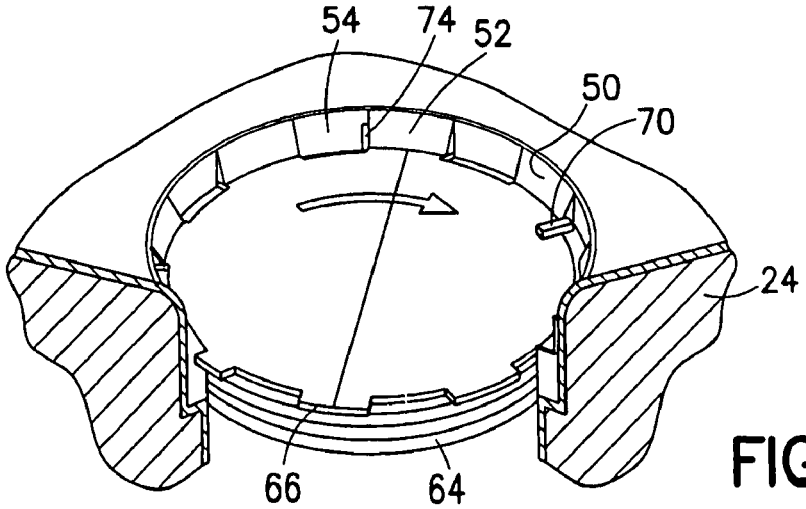
FIG. 6C shows a completed installation of the example nozzle dam of FIG. 6A into the example attachment ring of FIG. 5.

In a further example embodiment, a locking mechanism may be provided for locking the nozzle dam 62 in position in the attachment ring 50. For example, as shown in FIGS. 6A-6C, a flip-type locking tab 70 may also be provided for locking the nozzle dam 62 into the attachment ring 50 and preventing rotation in either direction. Alternatively, as shown in FIGS. 14B-16, a locking pin 72 may be used to secure the nozzle dam 62 to the attachment ring 50 and prevent rotation. Other types of locking mechanism which can be adapted for use with the present invention will be apparent to those skilled in the art.

In addition, a rotation limiting mechanism may be provided on the nozzle dam 62. For example, as shown in FIGS. 6A-6C, rotation limiting mechanism may comprise a rotation limiting protrusion or tab 74 provided on a side of one or more radial protrusions 66 that prevents over-rotation of the nozzle dam assembly 60 in the attachment ring 50 during installation. The rotation limiting tab 74 also ensures proper alignment of the retaining tabs 52 of the attachment ring 50 and the radial protrusions 66.

In a further example embodiment, a spring-loaded pin may be provided on the nozzle dam 62 which automatically interlocks with a corresponding slot or opening in the attachment ring 50. Such a spring-loaded pin may serve to prevent over-rotation of the nozzle dam 62 in the attachment ring 50 and to lock the nozzle dam 62 in position on the attachment ring preventing rotation in either direction (thus providing the function of the rotation limiting mechanism and the locking mechanism). The spring-loaded pin may be provided on an edge of the nozzle dam 62 between the radial protrusions 66. A release mechanism may be provided for retracting the spring-loaded pin from the attachment ring to enable removal of the nozzle dam 62 from the attachment ring 50.

Figure 7:
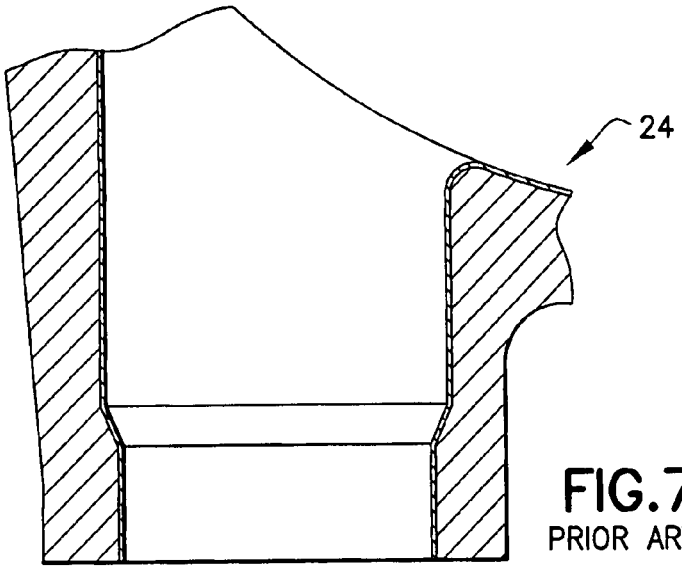
FIG.7 PRIOR ART
FIG. 7 shows a prior art cold leg nozzle design.
Figure 8A:
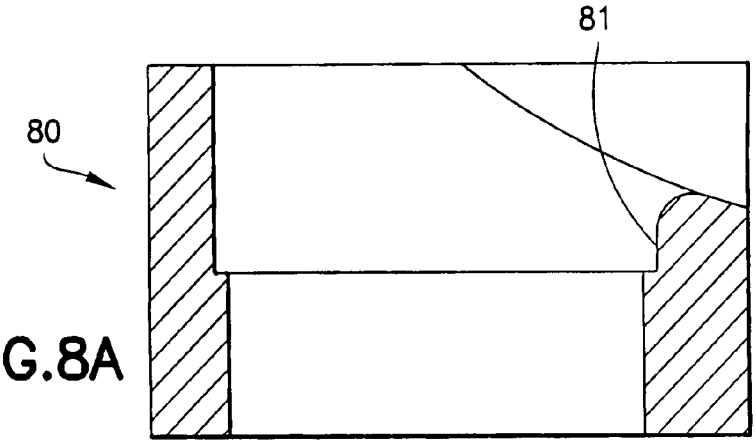
FIG. 8A shows an example embodiment of a machined cold leg nozzle prepared to accept cladding in accordance with an example embodiment of the invention.
Figure 8B:
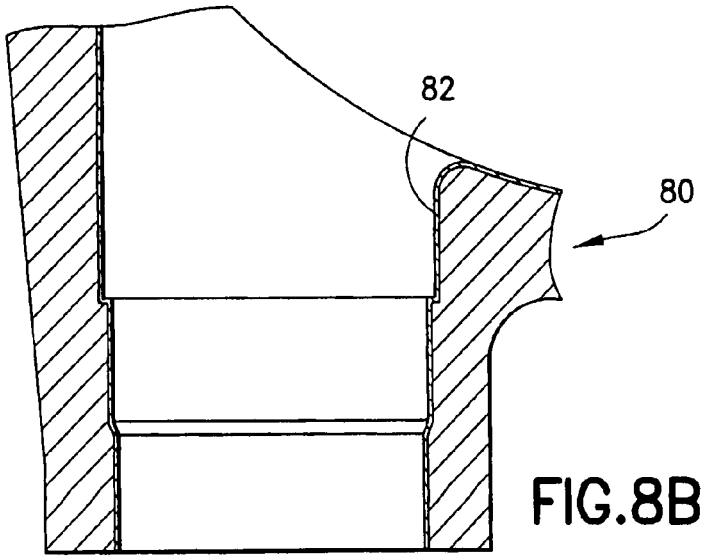
FIG. 8B shows a further example embodiment of the machined cold leg nozzle of FIG. 8A with cladding installed in accordance with an example embodiment of the invention.
Figure 17:
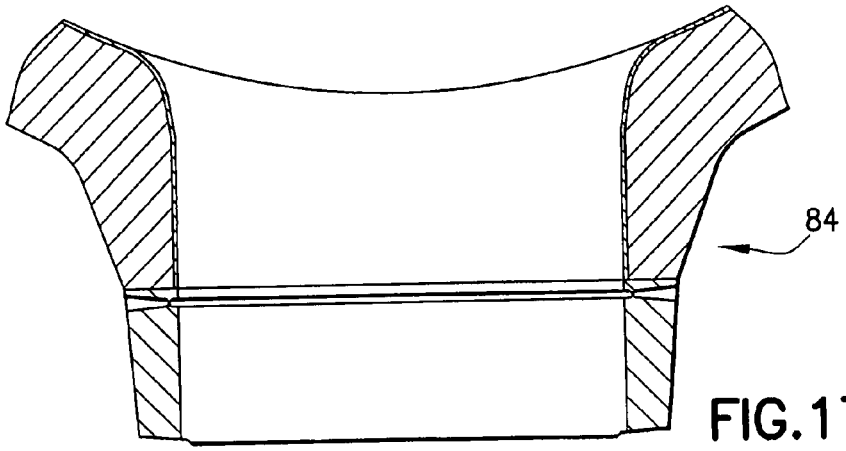
FIG.17 PRIOR ART
FIG. 17 shows a prior art hot leg nozzle design.
Figure 18A:
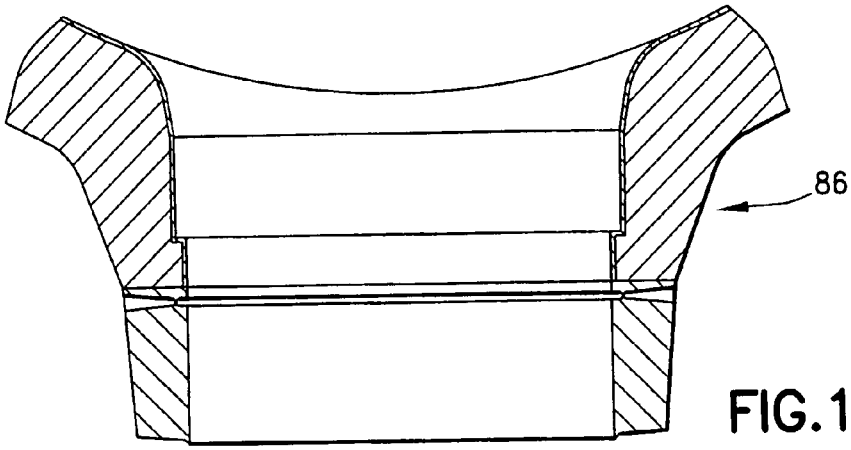
FIG. 18A shows an example embodiment of a machined hot leg nozzle prepared to accept cladding in accordance with an example embodiment of the invention.
Figure 18B:
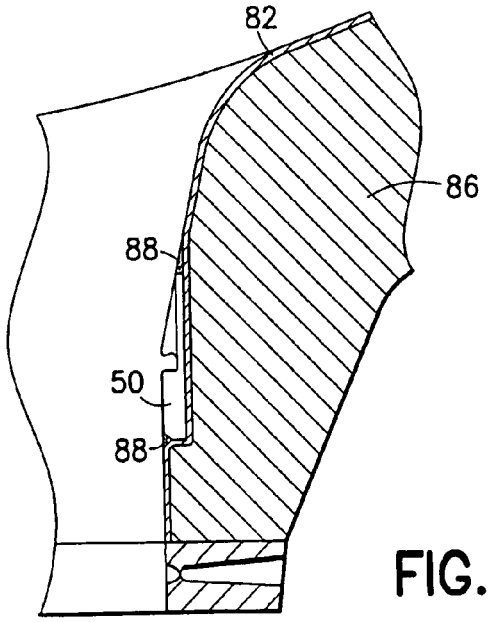
FIG. 18B shows a cross-section of an example embodiment of an attachment ring installed in a hot leg of a nozzle in accordance with an example embodiment of the present invention.

As shown in FIG. 5, the nozzle dam attachment ring 50 is adapted to be fitted inside a nozzle 24 of a steam generator 12 (FIG. 1). FIG. 7 shows an example of a prior art cold leg nozzle 24. With the present invention, as shown in the example embodiment of FIG. 8A, the inside 81 of the nozzle 80 may be machined to close tolerances to accept cladding sized to accept the attachment ring. FIG. 8B shows the machined cold leg nozzle 80 with cladding 82 installed in accordance with an example embodiment of the present invention. The hot leg nozzle of a steam generator 12 is of a slightly different shape. An example of a prior art hot leg nozzle 84 is shown in FIG. 17. A machined hot leg nozzle 86 in accordance with an example embodiment of the present invention is shown in FIG. 18A. Although the hot and cold leg nozzles are of slightly different shape, the example embodiments of the present invention described below in connection with a cold leg nozzle are equally applicable to a hot leg nozzle, with minor modifications to the dimensions of the nozzle dam, attachment ring, and cladding that would be apparent to one skilled in the art.

Figure 9:
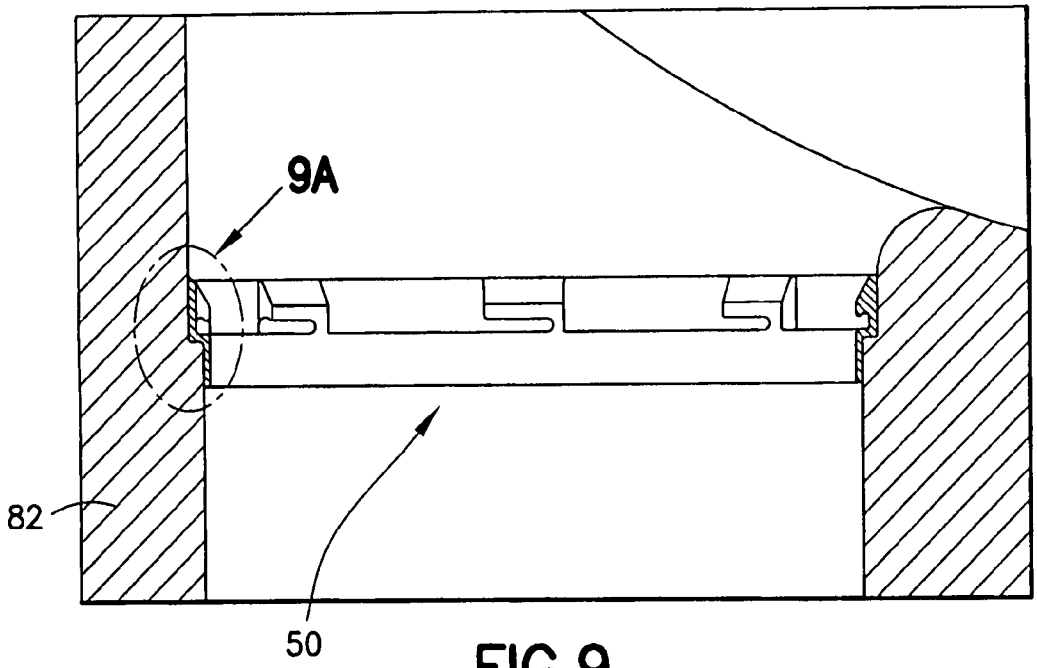
FIG. 9 shows an example embodiment of an attachment ring installed in the nozzle of FIG. 8A.
Figure 9A:
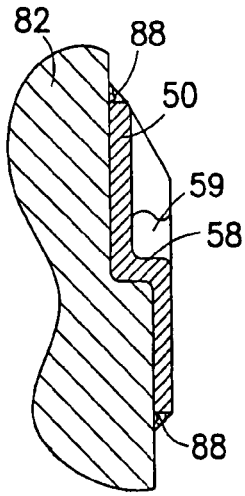
FIG. 9A is a close-up view from FIG. 9 of the area of attachment of the attachment ring to the nozzle.
Figure 10A:
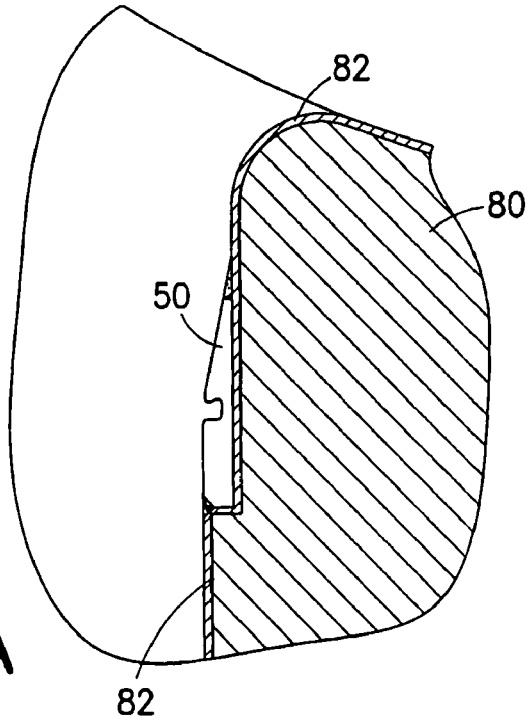
FIG. 10A shows a cross-section of an example embodiment of an attachment ring installed in a cold leg of a nozzle in accordance with an example embodiment of the present invention.
Figure 12:
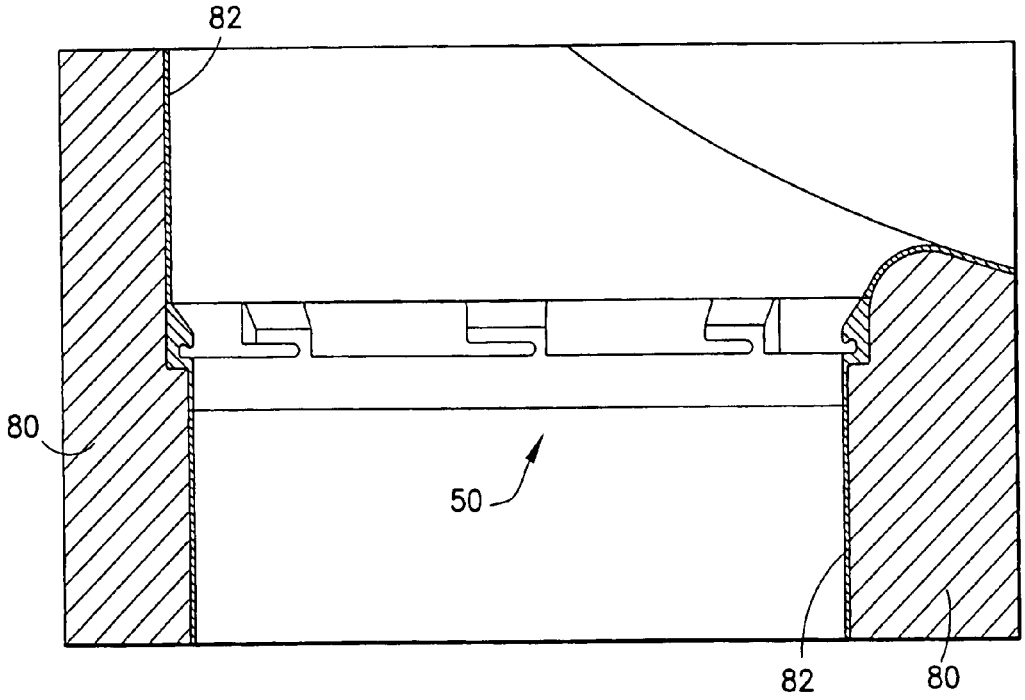
FIG. 12 shows a further example embodiment of an attachment ring installed in the nozzle of FIG. 8A.

The cladding 82 may be welded into the machined interior 81 of the nozzle 80 and machined in place. The attachment ring 50 may then be inserted into the cladding 82 and welded in place (see welds 88), as shown in FIGS. 9, 9A, and 10A (cold leg) and FIG. 18B (hot leg). The cladding 82 may extend above and below the attachment ring 50, as shown for example in FIG. 10A. The cladding 82 and the attachment ring 50 may be made of the same material, such as Inconel 690 or similar material, to preclude weld damage from differing thermal expansion characteristics of dissimilar material. Alternatively, the attachment ring 50 may be welded directly to the machined base metal of the nozzle 80 and the cladding 82 may be applied after the attachment ring 50 is installed, as shown in FIG. 12.

Figure 10B:
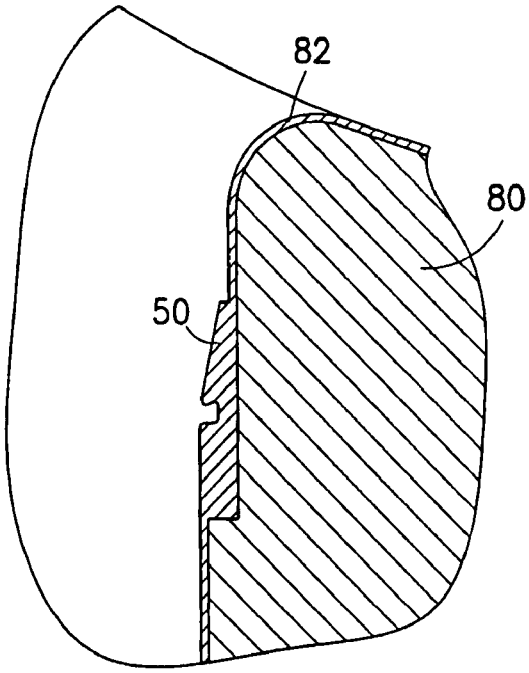
FIG. 10B shows a cross-section of a further example embodiment of an attachment ring installed in a cold leg of a nozzle in accordance with a further example embodiment of the present invention.

Alternatively, as shown in FIG. 10B, cladding 82 may be applied to the machined interior of the nozzle 80 and the attachment ring 50 may be machined directly from the cladding 82 once the cladding 82 is secured in place.

The attachment ring 50 may be provided with a temporary protective shield (not shown) to preclude weld splatter and/or other damage to the attachment ring 50 during installation in the nozzle 80.

As can be seen in FIGS. 5 and 15, a top portion of the ring 50 includes a plurality of equally spaced apart nozzle dam retaining tabs 52 extending towards the center of the ring 50 that serve to retain the radial protrusions 66 on the nozzle dam 62. The number of retaining tabs 52 on the attachment ring 50 corresponds to the number of radial protrusions 66 on the nozzle dam 62. Receiving slots 54 are formed between the retaining tabs 52. As shown in FIG. 5, a lower portion of the inner surface of the ring comprises a machined sealing surface 56 for forming a seal with the inflatable seal 64 of the nozzle dam assembly 60. A nozzle dam landing 58 is provided in the inner surface of the ring 50 above the machined sealing surface 56 for accepting the nozzle dam assembly 60.

Figure 11:
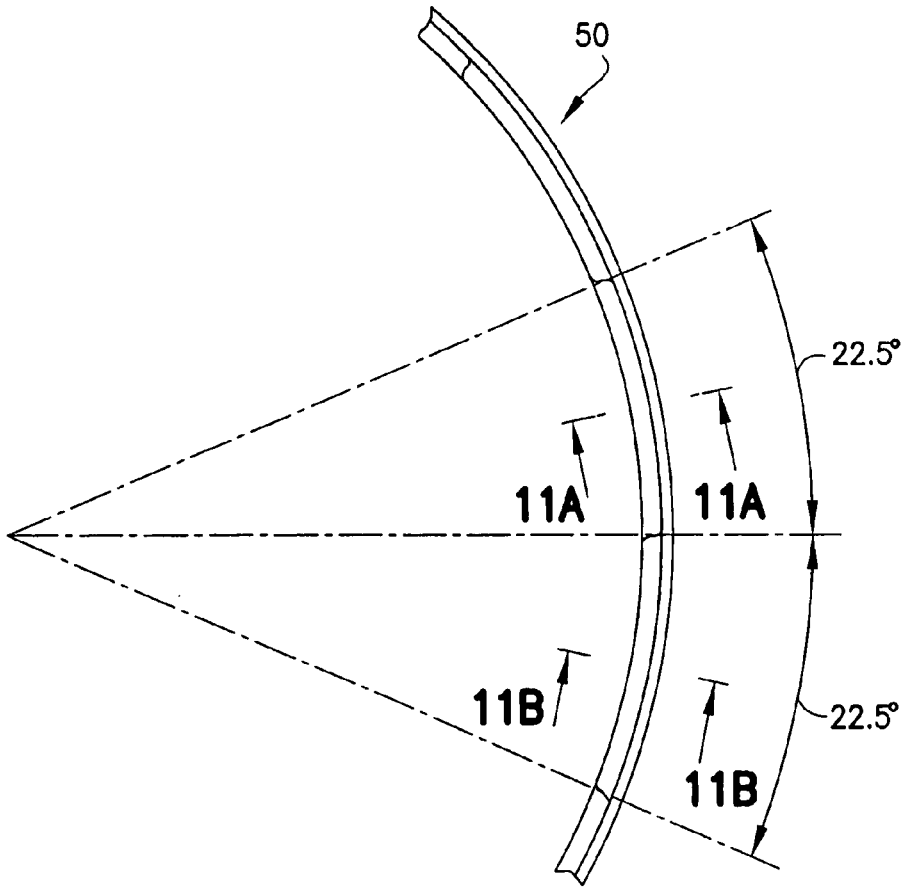
FIG. 11 shows the basic geometry of an example embodiment of an attachment ring for a cold leg nozzle.
Figure 11A:
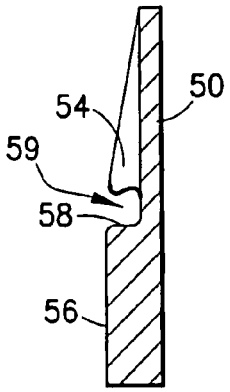
FIG. 11A shows a cross-section of a portion of the example attachment ring of FIG. 11.
Figure 11B:
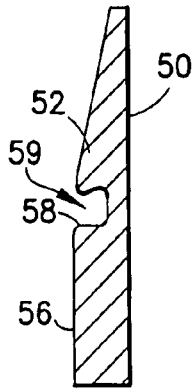
FIG. 11B shows a cross-section of a further portion of the example attachment ring of FIG. 11.
Figure 13:
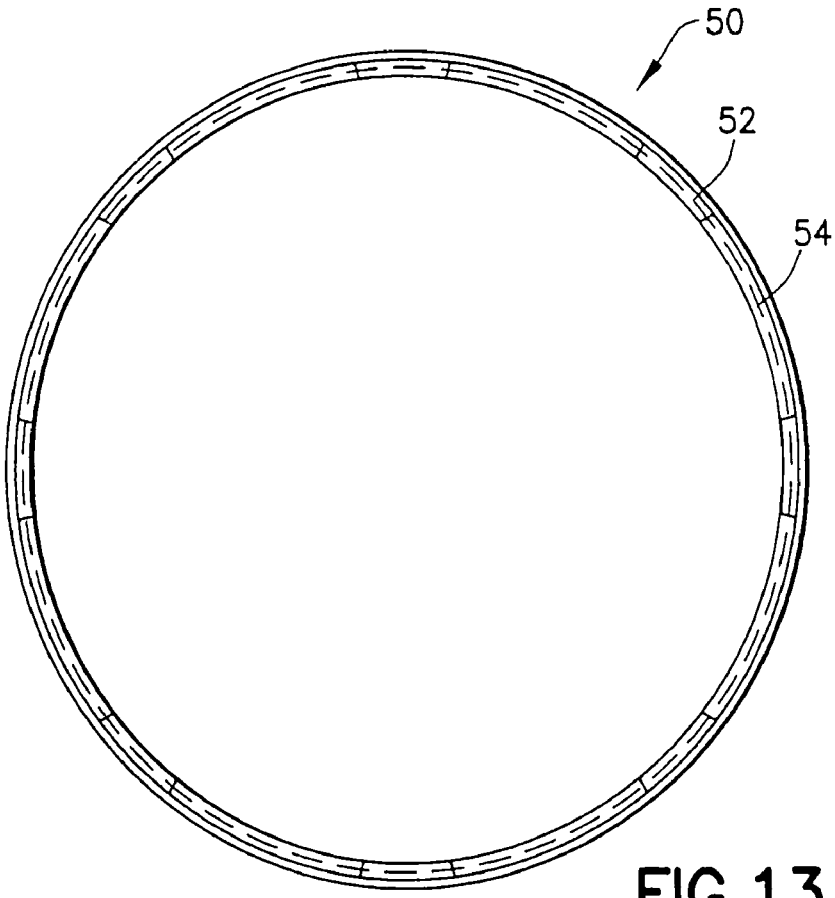
FIG. 13 shows a top view of an example embodiment of an attachment ring in accordance with the present invention.
Figure 13A:
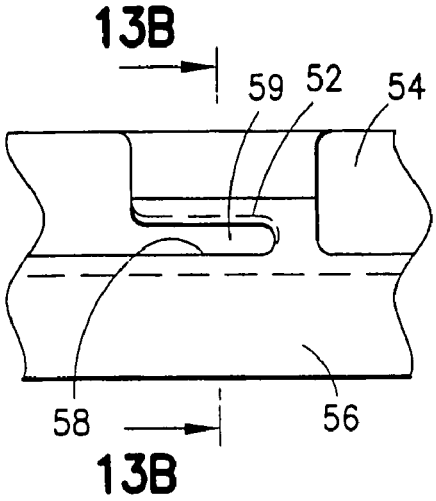
FIG. 13A shows a side view of the example attachment ring of FIG. 13.
Figure 13B:
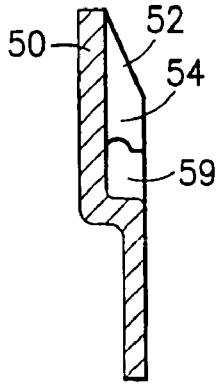
FIG. 13B shows a cross-section from FIG. 13B of a portion of the attachment ring.
Figure 19B:
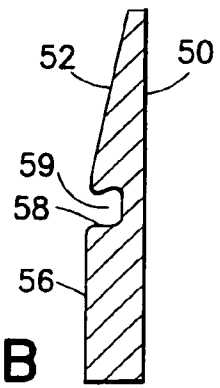
FIG. 19B shows a cross-section of a further portion of the example attachment ring of FIG. 19.
Figure 19A:
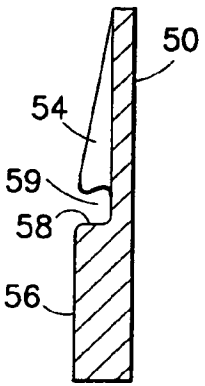
FIG. 19A shows a cross-section of a portion of the example attachment ring of FIG. 19.
Figure 19:
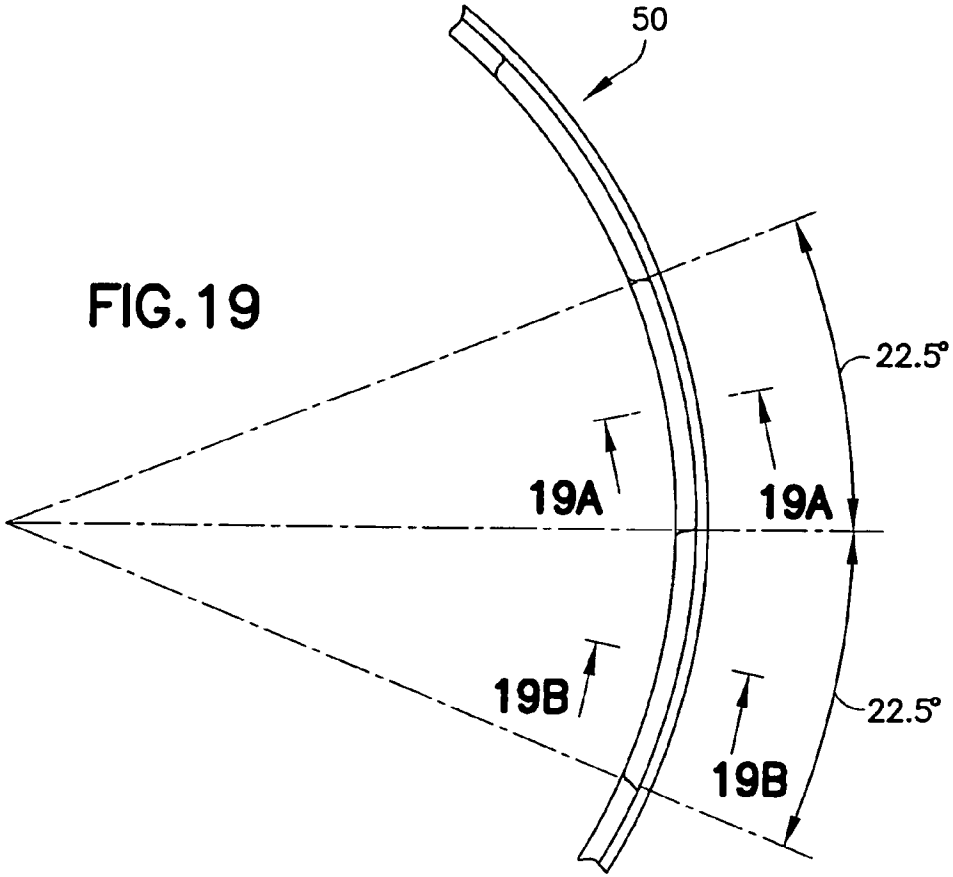
FIG. 19 shows the basic geometry of an example embodiment of an attachment ring for a hot leg nozzle.

FIGS. 11 and 19 show the basic geometry of a cold and hot leg of an attachment ring 50, respectively, in accordance with example embodiments of the present invention. FIGS. 11A and 19A show a section through a portion of the attachment ring 50 in the area of the receiving slots 54, and FIGS. 11B and 19B show a section through a portion of the attachment ring 50 in the area of the retaining tabs 52. As can be seen in FIG. 1B, a slot 59 is formed between the bottom portion of retaining tab 52 and the nozzle dam landing 58 which is adapted to accept the radial protrusions 66 of the nozzle dam 62. FIG. 13 shows a top view of the attachment ring 50. FIG. 13A shows a side view of the attachment ring 50 and FIG. 13B shows a cross section of the attachment ring 50.

In one example embodiment, the seal 64 may comprise an inflatable seal. The seal 64 may be pressurized remotely after interlocking of the nozzle dam 62 in the attachment ring 50. A computerized pressurization control and monitoring station may be provided for controlling and monitoring the remote pressurization of the seal. Methods and apparatus for pressurizing the seal and controlling and monitoring the seal pressure are discussed below in connection with FIGS. 21-24.

Figure 2:
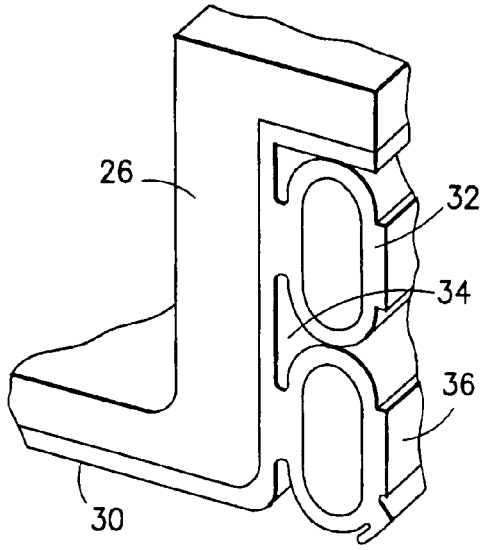
FIG. 2 PRIOR ART
FIG. 2 shows a diaphragm and seal of a prior art nozzle dam assembly.

In one example embodiment, the seal 64 may comprise a segmented seal having a diaphragm 30 extending over one side of the nozzle dam 62 and at least one pneumatic seal 32, 36 extending around a circumference of the nozzle dam 62. For example, two pneumatic seals 32, 36 may be provided with an annulus 34 arranged therebetween, as shown in FIG. 2. The seal 64 may surround the edge of the nozzle dam 62 and provide sealing between the side of the nozzle dam 62 and the attachment ring 50 fixed to the steam generator nozzle wall, which is typically cylindrical in shape.

The segments of the seal 64 may be adapted to be pressurized and monitored independently by a pressurization control and monitoring station 100, as discussed in detail in connection with FIG. 21 below. Each of these seal regions 32, 34, 36 may be independently energized with compressed air from a main supply. An emergency back-up supply of bottled gas is typically provided in case of failure of the main supply. Flexible air lines connect the nozzle dam assembly 62, air supplies and the pressurization control and monitoring station 100. The wet seal 36 and dry seal 32 effect a seal between the nozzle dam 62 and the attachment ring 50 fixed to the steam generator nozzle wall, while the annulus 34 is pressurized to monitor the integrity of the seals 32, 36 while in operation.

The diaphragm 30 may comprise a mechanical seal in the area of either the wet seal 36 or the dry seal 32 which is activated by the flow of water being retained by the nozzle dam 62 in the unlikely event that the inflatable seals 32, 34, 26 are compromised.

Figure 1A:
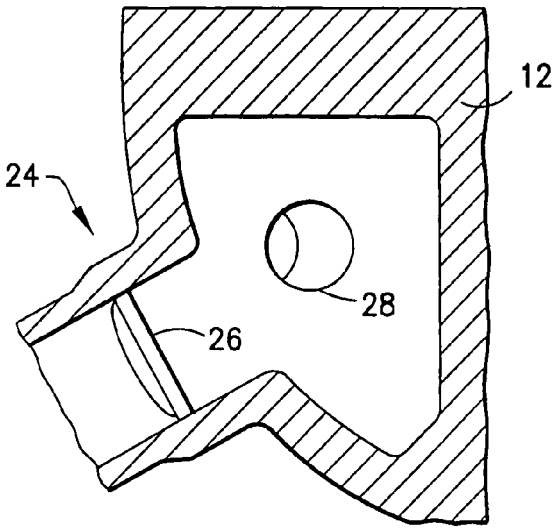
FIG. 1A PRIOR ART
FIG. 1A shows a partial cutaway view from FIG. 1 of a prior art nozzle dam installed in a steam generator nozzle.
Figure 16:
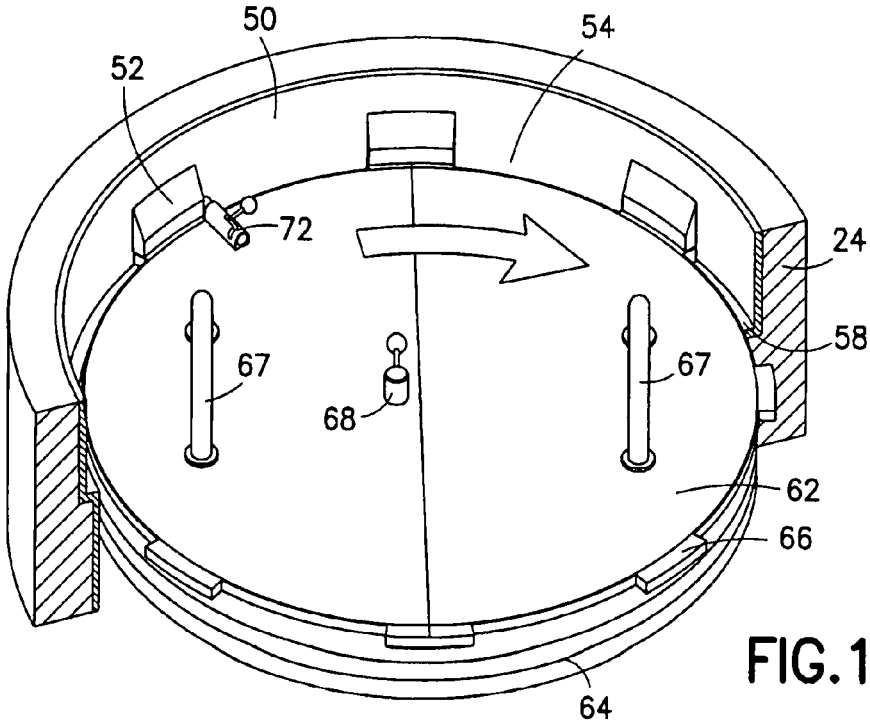
FIG. 16 shows a cutaway view of a completed installation of the example nozzle dam into the example attachment ring of FIG. 15A.

In order to install the nozzle dam assembly 60 prior to maintenance of the steam generator 12, the nozzle dam assembly 60 is folded in half and passed through the manway 28 (FIG. 1A) to an installer who has climbed into the steam generator 12 through the manway 28. The nozzle dam assembly 60 can then be opened from the folding position. The two segments 62*a* and 62*b* can optionally be locked together using the center locking unit 68. The nozzle dam assembly 60 may then be set into the attachment ring 50. The radial protrusions 66 of the nozzle dam 62 can then be aligned with the receiving slots 54 in the attachment ring 50 and the nozzle dam assembly 60 can then be lowered (e.g., via handles 67) until the nozzle dam 62 rests against the nozzle dam landing 58, as shown in FIGS. 6A-6B and FIGS. 15A-15B. The nozzle dam assembly 60 can then be rotated so that the radial protrusions 66 slide into the slot 59 formed between the corresponding retaining tabs 66 and the nozzle dam landing 58, interlocking the nozzle dam 62 with the attachment ring 50, as shown in FIGS. 6C and 16. In an example embodiment shown in FIGS. 5-6C where a rotation limiting tab 74 is provided on a radial protrusion 66, the nozzle dam assembly 60 is rotated until the rotation limiting tab 74 abuts against a corresponding retaining tab 52, as shown in FIG. 6C. The nozzle dam assembly 60 may thereafter optionally be secured in this interlocked position using a locking tab 70 (FIG. 6C) or locking pin 72 (FIG.

16), which is adapted to prevent the nozzle dam assembly 60 from rotating in either direction. Once the locking tab 70 or locking pin 72 is set, the installer exits the manway 28. The inflatable seal 64 can then be pressurized to effect a watertight seal between the attachment ring 50 and the nozzle dam 62. Inflation of the seal 64 is controlled remotely. Therefore, the seal 64 can be pressurized as soon as the nozzle dam 62 is secured in the attachment ring 50 or anytime after the installer exits the manway 28.

Removal of the nozzle dam assembly 60 is simply the reverse of the installation procedure.

Figure 3:
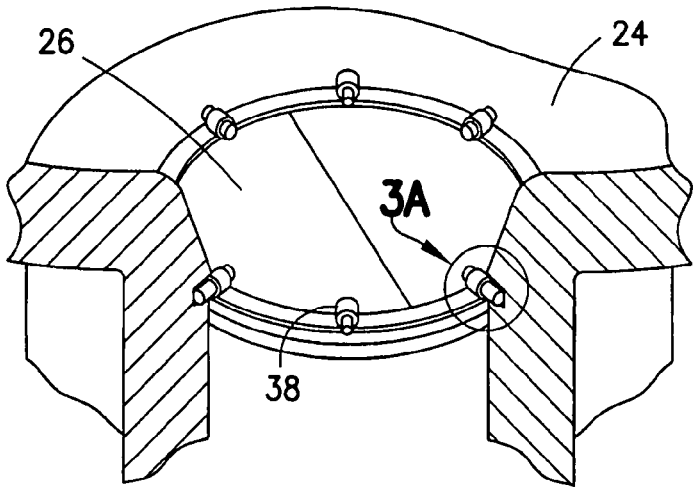
FIG.3 PRIOR ART
FIG. 3 shows an example of a prior art nozzle dam.
Figure 3A:
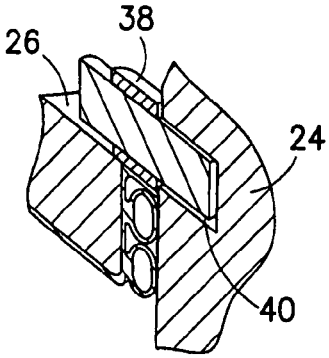
FIG. 3A shows a partial cutaway view from FIG. 3 of a radial pin of the nozzle dam of FIG. 3 inserted into a hole of the nozzle.
Figure 4:
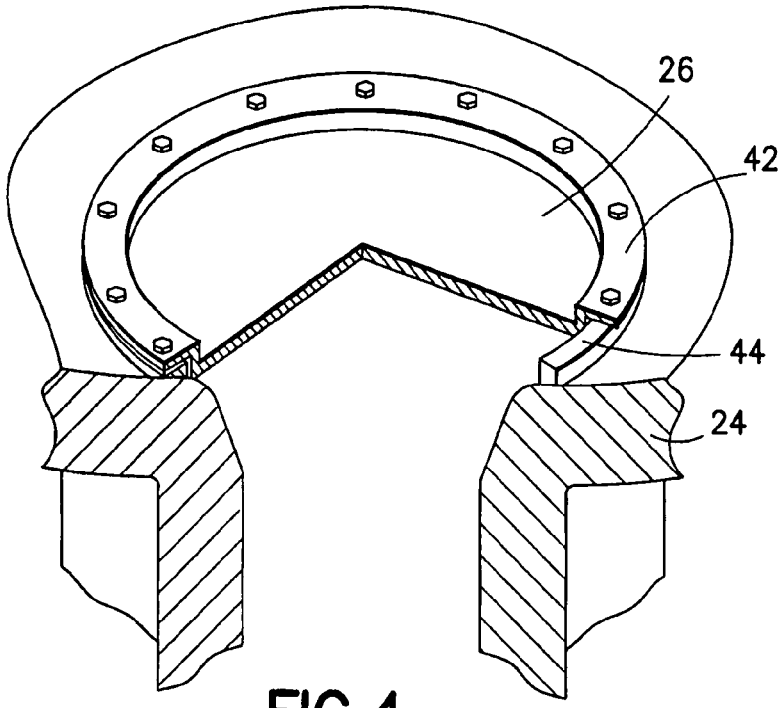
FIG.4 PRIOR ART
FIG. 4 shows a further example of a prior art nozzle dam.

The time required for installation or removal of the nozzle dam assembly 60 is estimated at approximately 30 seconds, which is considerably faster than prior art nozzle dams (FIGS. 3 and 4) that require the manipulation of multiple bolts or pins during installation and removal.

In a typical steam generator 12, the nozzle 24, 84 widens at the junction of the nozzle and the body of the steam generator 12. For example, this junction may be funnel shaped, as shown in FIG. 17. By machining the interior surface of the nozzle and providing cladding 82 for accepting the attachment ring 50 in accordance with the present invention, the attachment ring 50 can be placed at a point in the nozzle 86 having a smaller diameter than could be achieved with prior art nozzle dam retrofit designs. Thus, the nozzle dam assembly 60 in accordance with the various embodiments of the present invention has a smaller diameter than prior art nozzle dam designs. It should be appreciated that the water pressure forces increase substantially as the radius of the nozzle increases (i.e., by the square of the diameter). By placing the nozzle dam assembly 60 in the nozzle 86 at a location having a smaller diameter than prior art designs, the forces which the nozzle dam 62 of the present invention will be subjected to will be much less than compared to prior art designs. Therefore, due to the smaller size of the nozzle dam assembly 60 and the lower forces, the nozzle dam assembly 60 of the present invention is smaller, lighter, and easier to handle as compared to prior art designs, and can thus be installed quicker and with less effort. Further, since the nozzle dam assembly 60 is secured against linear movement in the nozzle due to the interlocking of the radial protrusions 66 and retaining tabs 52, multiple screws or pins are not required to secure the nozzle dam in place. A simple rotation of the nozzle dam assembly 60 in the attachment ring 50 secures the nozzle dam assembly 60 against linear movement. Only a simple locking mechanism 70, 72 is required to secure the nozzle dam assembly 60 against rotational movement, as the installed nozzle dam assembly 60 is not subject to any significant rotational forces. Further, the nozzle dam assembly 60 of the present invention is less prone to failure than prior art designs due to the reduced number of movable parts. In particular, multiple bolts and pins are not required to secure the nozzle dam assembly 60 in place.

The drawings show example embodiments of the present invention in which the nozzle dam 62 has eight radial protrusions 66 and the attachment ring 50 has eight corresponding retaining tabs 52. However, one skilled in the art should appreciate that the present invention may be implemented with a varying number of radial protrusions 66 and corresponding retaining tabs 52.

It should be appreciated that the present invention can be used in a nozzle of both a hot or cold leg of a steam generator, or in any other nozzle where sealing against water pressure is required, such as in the petrochemical industry or the like.

Figure 20:
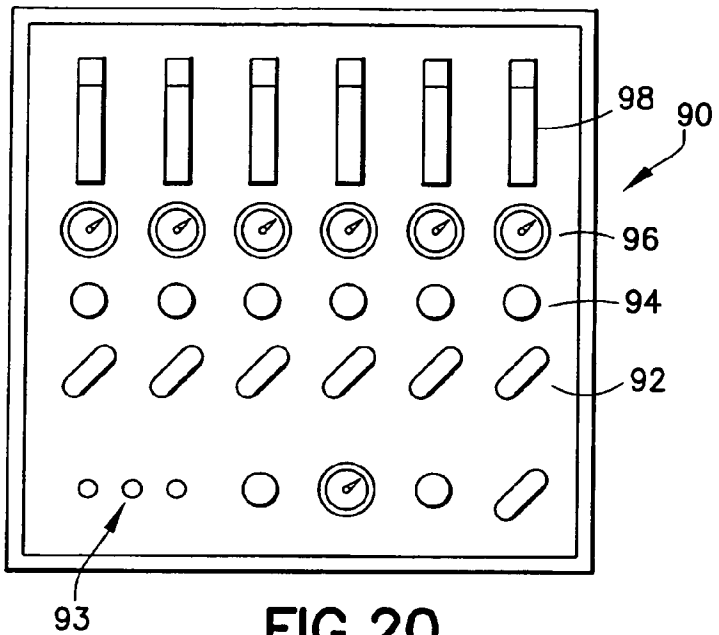
FIG.20 PRIOR ART
FIG. 20 shows a prior art nozzle dam support console.

The present invention also provides methods and apparatus for the pressurization and control of steam generator nozzle dam seals. An example of a prior art nozzle dam support console 90 is shown in FIG. 20. This support console 90 is connected to the seal regions 32, 34, 36 via air lines (connected via air line connectors 93) and serves as the pneumatic distribution center to each of the seal regions 32, 34, 36, and also monitors the air flow in each region. Such prior art consoles 90 are typically constructed with analog pneumatic devices, (i.e. valves 92, regulators 94, pressure gauges 96, and flow indicators 98), which make the unit cumbersome, requires extensive maintenance, and requires a highly trained operator for its operation.

Monitoring air flow in the seal regions, as well as providing regulated air pressure, is a major function of the nozzle dam console 90. If an air flow condition exists during operation, an alarm will sound to alert the operator, and other personnel in the immediate area, of a potential reactor water leak or air pressure loss at the nozzle dam. The operator must then determine the source of the problem. With prior art systems, the operator must typically refer to an extensive manual to determine an appropriate corrective response, which is time consuming and may lead to errors.

As shown in FIGS. 21-23B, the present invention provides a computerized nozzle dam support console 100 (also referred to herein as a pressurization control and monitoring station) for pressurization and control of a nozzle dam seal 64 that is simple to use, small in size, automatically identifies corrective actions to be taken, and can be remotely monitored and controlled.

Figure 21:
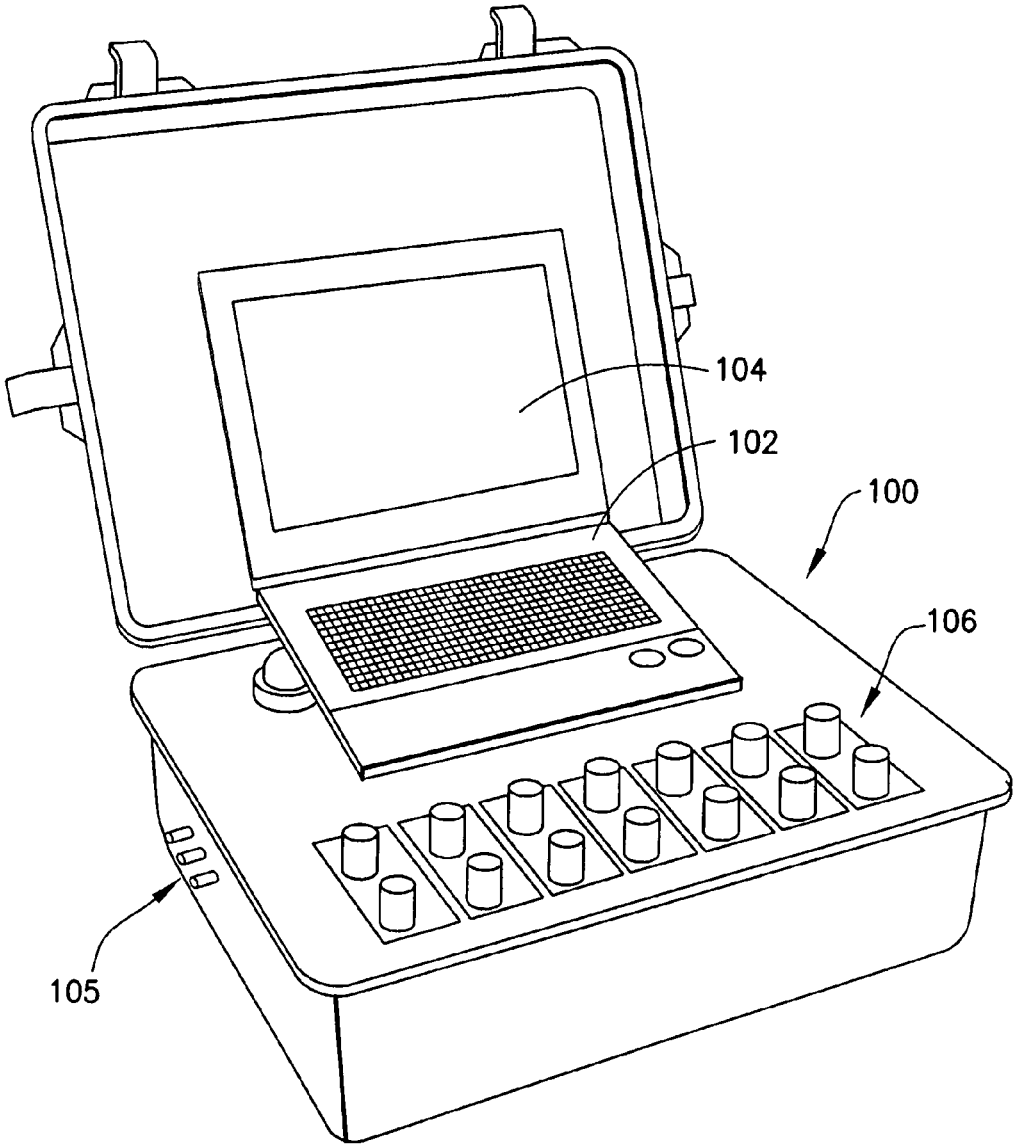
FIG. 21 shows an example embodiment of a nozzle dam support console in accordance with the present invention.
Figure 22:
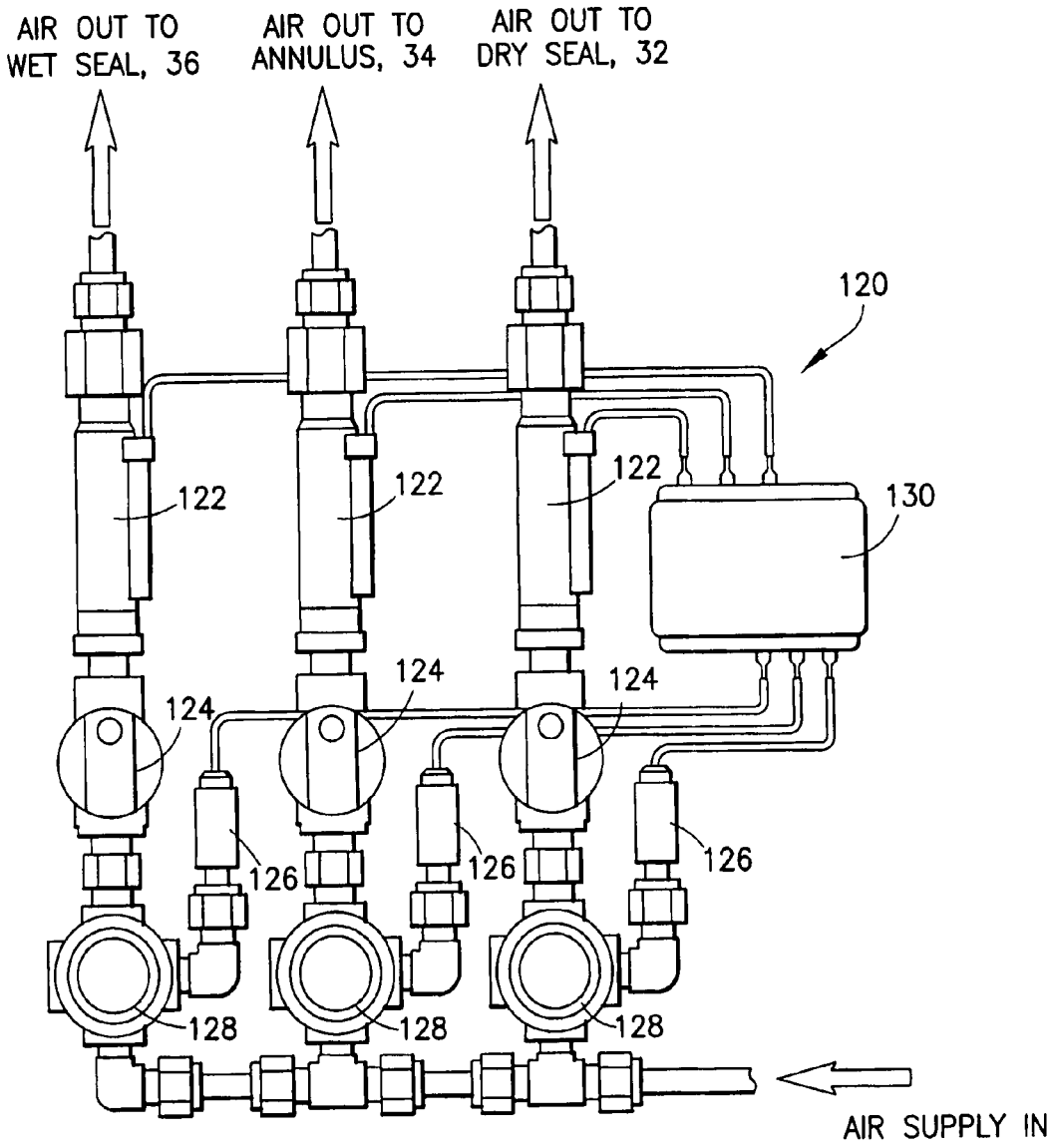
FIG. 22 shows an example embodiment of a pneumatic distribution system in accordance with the present invention.

In one example embodiment of the present invention, as shown in FIG. 21, the nozzle dam support console 100 utilizes a computer 102 to digitally interface with an analog pneumatic distribution system, which includes air supplies and flexible air lines connecting the seal regions to the air supplies and the console. FIG. 22 shows an example embodiment of a distribution system 120 in accordance with the present invention. The distribution system 120 may include, for each seal region 32, 34, and 36, a flow switch 122, valve 124, digital pressure transducer 126, and regulator 128 connected to flexible air lines for delivering and controlling the air supply and pressure to each seal region (dry seal 32, wet seal 36, and annulus 34). The distribution system 120 may be included within the console 100, which is provided with air-line connections 105 to the distribution system 120 for accepting air lines from the seal regions 32, 34, 36.

A data acquisition module 130 receives information from the digital pressure transducers 126 and flow switches 122, and communicates this information to the nozzle dam support console computer 102. The information received from the data acquisition module 130 may be displayed on a console display 104 and monitored by a processor of the computer 102. The system may also be monitored remotely.

It should be appreciated that the example embodiment shown in FIG. 21 is an air distribution system 120 for use with two nozzle dam assemblies (e.g., one for the hot leg and one for the cold leg of the steam generator 12). The console 100 and distribution system 120 may be adapted to support three nozzle dam assemblies for steam generators having one hot leg nozzle and two cold leg nozzles with respective nozzle dam assemblies. Those skilled in the art will appreciate that several nozzle dam air distribution systems 120 may be ganged together so that the seals of multiple nozzle dams can be monitored and controlled by a single support console.

Figure 23A:
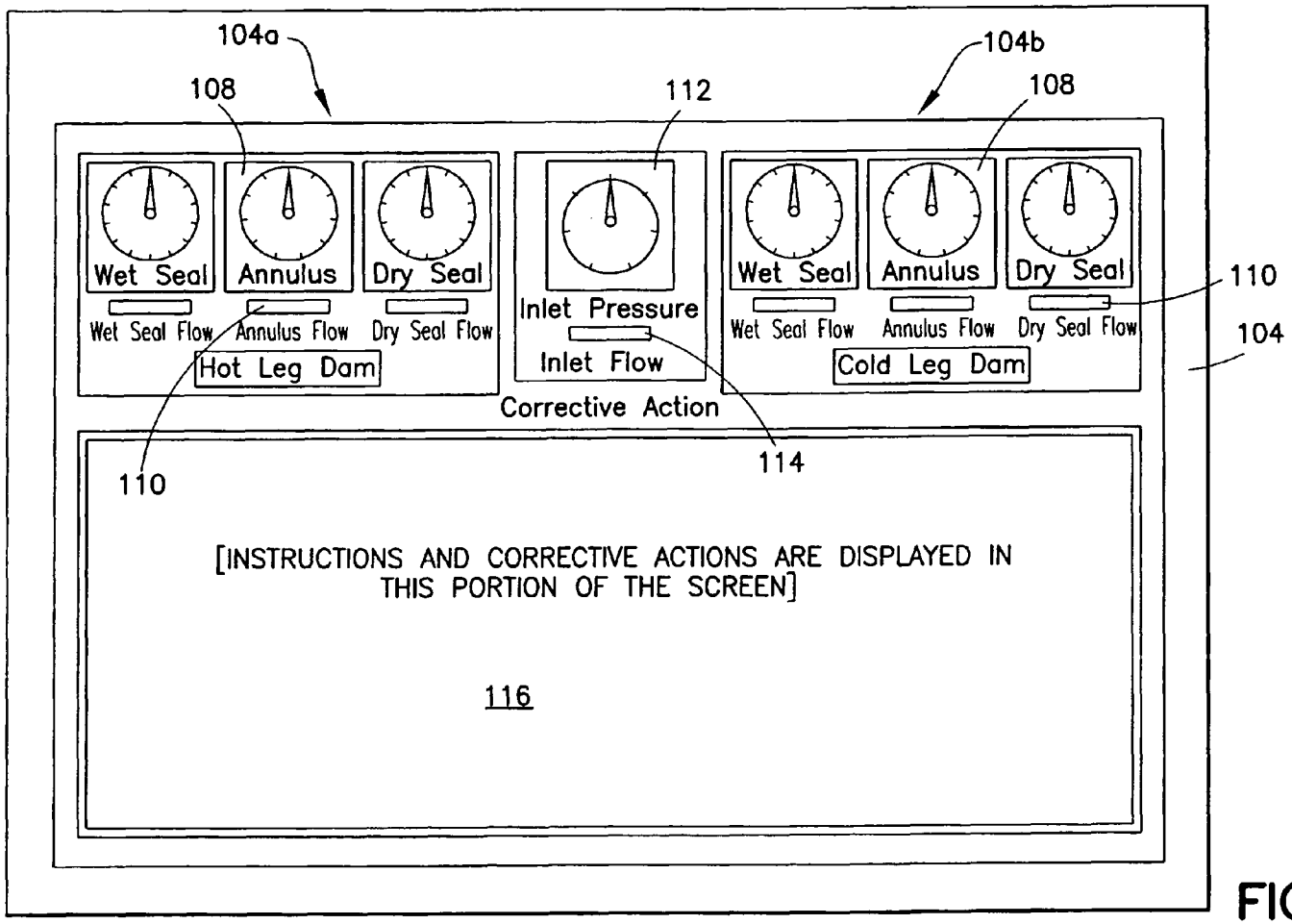
FIG. 23A shows a detailed view of the display of the nozzle dam support console shown in the FIG. 21 example embodiment.
Figure 23B:
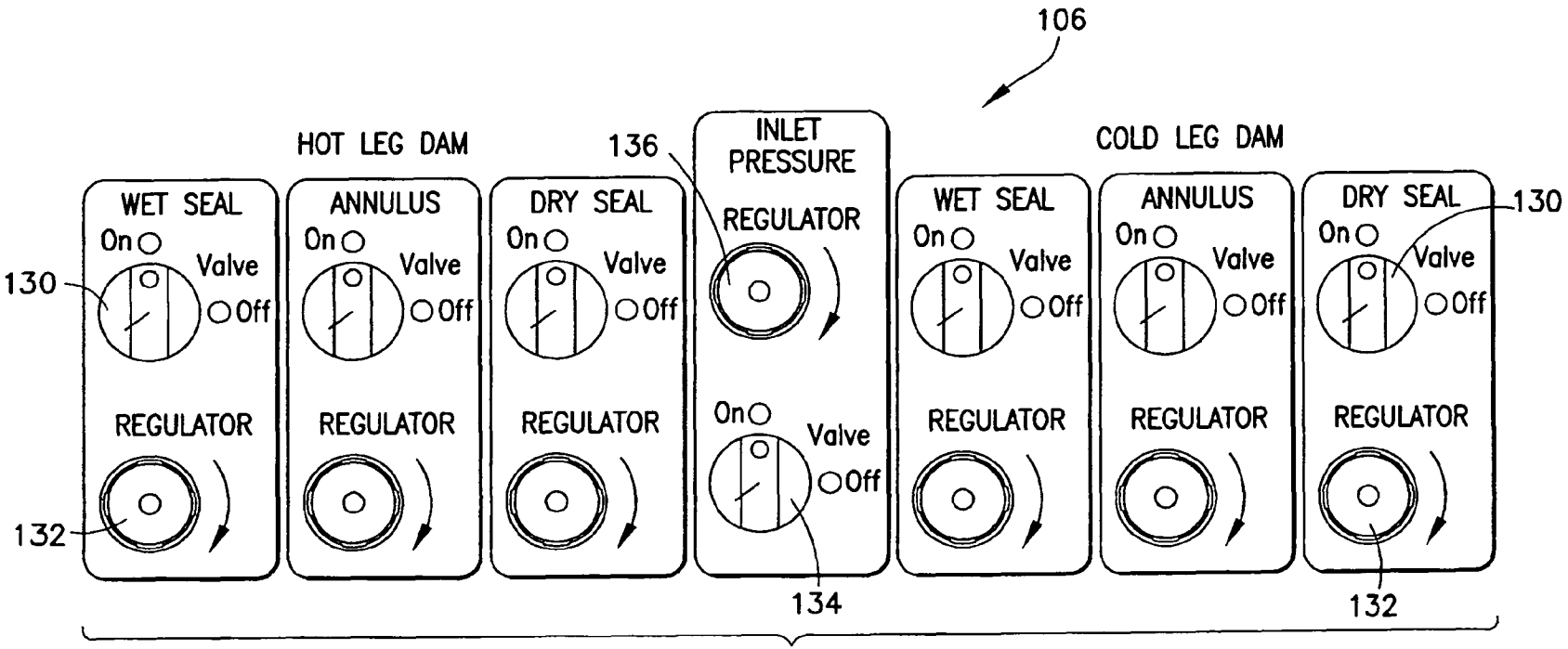
FIG. 23B shows a detailed view of the nozzle dam support console control panel shown in the FIG. 21 example embodiment.

FIG. 23A shows a detailed view of a display 104 for the nozzle dam support console 100 shown in the FIG. 21 example embodiment, while FIG. 23B shows a detailed view of a control panel 106 of the console 100 shown in the FIG. 21 example embodiment. As shown in FIG. 23A, the display 104 may be configured to monitor and control the seal regions of two nozzle dams, one section 104*a* of the display 104 for the hot leg of a steam generator and another section 104*b* of the display 104 for the cold leg of a steam generator. As discussed above in connection with FIG. 22, in such an example embodiment there will be separate air distribution systems 120 for each nozzle dam seal (e.g., hot leg seal and cold leg seal), which may be ganged together and connected to a single data acquisition module. Alternatively, the air distribution system 120 for each nozzle dam seal may be connected to a separate data acquisition module 130, and each such data acquisition module 130 may communicate data from each distribution system 120 to the console 100 separately.

As shown in FIG. 23A, the display 104 may include separate pressure gauges 108 and flow indicator lights 110 for the wet seal 36, dry seal 32, and annulus 34 for each nozzle dam seal 64. The display may also include an inlet pressure gauge 112 and inlet flow indicator light 114. The display 104 also includes an area 116 for displaying instructions or corrective actions.

During installation of the nozzle dam assembly 60, a seal activation sequence may be displayed on the console display 104 indicating the sequence in which the seal regions 32, 34, 36 should be pressurized and the final pressure of each such region. As shown in FIG. 23B, the console control panel 106 may include, for each seal region, a valve switch 130 for remotely opening and closing the respective valve 124 and a pressure regulator control 132 for remotely controlling the respective regulator 128. The console control panel 106 may also include a valve switch 134 for opening or closing a valve of the inlet air supply and a pressure regulator control 136 for remotely controlling a pressure regulator for the inlet air supply and/or a backup air supply.

While the prior art seals typically utilize three seal segments as shown in the FIG. 2, those skilled in the art will readily appreciate that the present invention can be used to pressurize and control a nozzle dam seal 64 having more or less than three seals.

Figure 24:
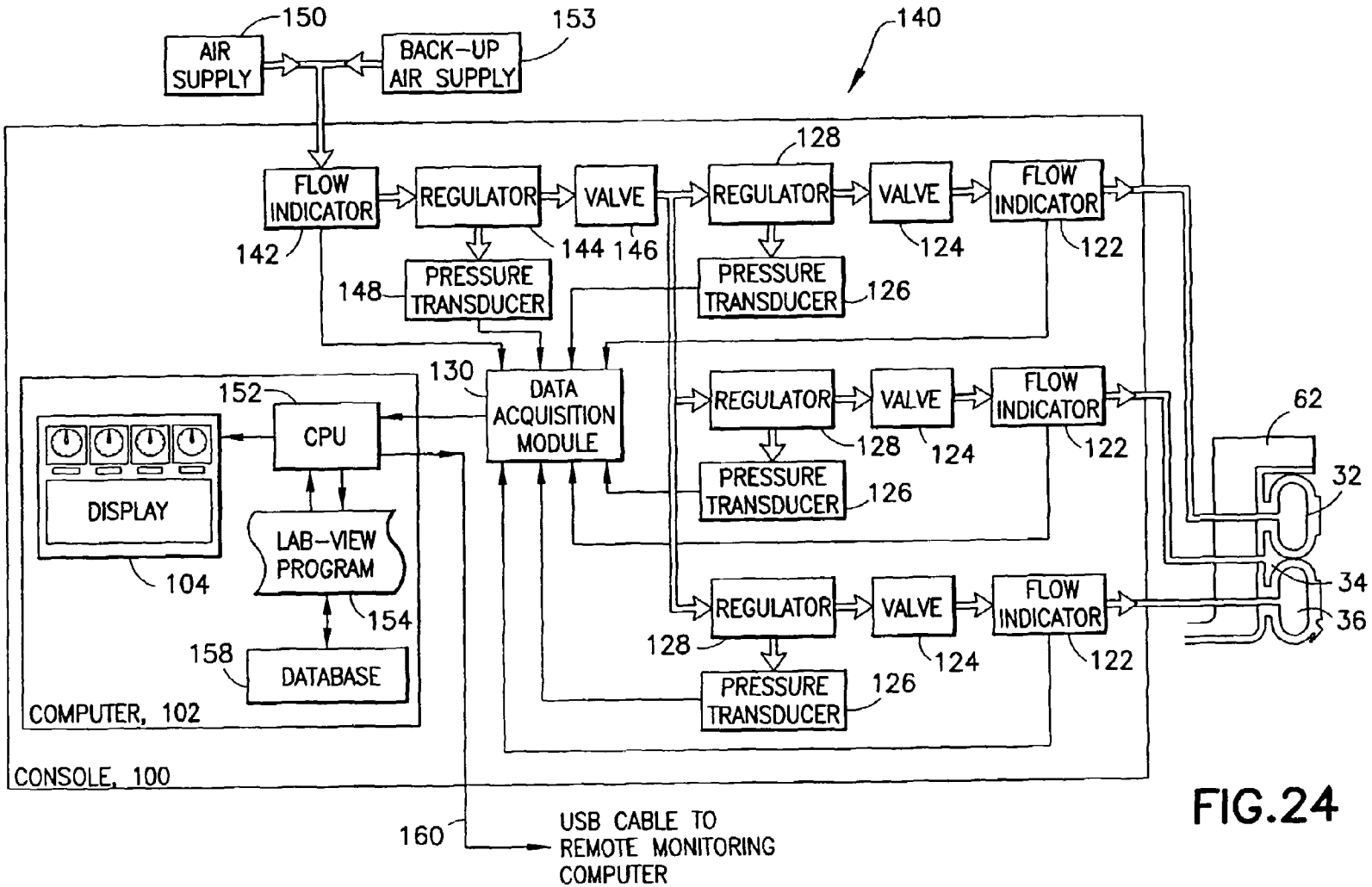
FIG. 24 shows a block diagram of an example system for pressurizing and controlling nozzle dam seals in accordance with the present invention.

FIG. 24 shows a block diagram of an example embodiment of a system 140 for pressurizing and controlling the nozzle dam seals in accordance with the present invention. In addition to the elements shown in FIG. 22, the distribution system as shown in FIG. 22 may also include a flow indicator 142, regulator 144, valve 146, and pressure transducer 148 positioned between the inlet air supply 150 (or backup air supply 153) and the data acquisition module 130. The data acquisition module 130 may continually provide updated pressure and flow readings for the various seal regions 32, 34, 36, as well as for the inlet air supply 150. Once the nozzle dam seal regions 32, 34, 36 are initially pressurized, software running on a processor (CPU) 152 in the computer 102 will monitor the data obtained from the pressure transducers 126, 148 and flow switches 122, 142 by the data acquisition module 130. The software running on the processor may comprise a program 154 written using Lab View or other appropriate software. The pressure and flow information for each seal region 32, 34, 36 and for the inlet air supply 150 is communicated to the display 104 and displayed using respective pressure gauges and flow indicators as discussed above in connection with FIG. 23A.

The processor 152 may sound an alarm in the event that the pressure falls below a preset minimum pressure or rises above a preset maximum pressure, or if air flow is detected in a seal region. Event alarms may be audible and/or visual. The visual alarm indicators may identify if a particular seal or the inlet air supply is the cause for the alarm, and whether the problem relates to an overpressure, underpressure, or a flow condition for the particular seal or inlet air supply. The visual alarm may comprise an intermittent flashing of a pressure gauge bezel 108, 112 for the corresponding seal region at issue or the inlet air supply in the event of a high or low pressure condition. The visual alarm may also comprise intermittent flashing of a flow monitor 110, 114 for the corresponding seal region or the inlet air supply at issue in the event of a flow condition. Multiple audible and/or visual alarms may sound simultaneously or sequentially in the event of multiple events relating to pressure and flow conditions for one or more of the seal regions 32, 34, 36 or the inlet air supply 150.

The present pressures for the seal regions and the inlet air supply may be stored in a database 158 of the control console 100. In addition to sounding an audible and/or visual alarm in the event the processor 152 determines that the pressure exceeds the maximum or minimum limit for a particular region or for the inlet air supply 150, or detects a flow condition, the processor 152 will determine appropriate corrective action instructions. The corrective action instructions can then be displayed on the console display screen 104 should an event occur that requires the attention of the operator (e.g., in screen section 116 shown in FIG. 23A). The corrective action instructions may be stored on the database 158. The processor 152 may select the appropriate corrective action from the database 158 based on a pre-stored set of logic rules which depend on the pressure reading, flow condition, and/or whether one or more particular seal regions or the inlet air supply is at issue. The corrective action instructions may include detailed information to enable the operator to resolve the event at issue.

As an example, in the event air flow is detected in the cold leg dry seal, the dry seal flow indicator light for the cold leg may flash and/or an audible alarm may sound. In addition, the following corrective action may be displayed on section 116 of the console display screen 104:

AIR FLOW IN COLD LEG DRY SEAL HAS BEEN DETECTED

1. Ensure that the hose connections at the back of the Monitor Case and Nozzle Dam are properly connected 2. If properly connected, then the dry seal is leaking air. Notify the control room immediately.

3. If the operating pressure in the seal cannot be maintained, turn the Dry Seal and Annulus valves to the OFF position.

4. It is recommended that the cavity be drained down and this seal be replaced Notify the control room.

As shown in the example embodiment of FIG. 24, the air distribution system 120, including the pressure transducers 126, 148, regulators 128,144, valves 124, 146, flow indicators 122, 142 and data acquisition module 130 may be included as a part of the nozzle dam support console 100. Alternatively, the air distribution system 120 may be remote from the computer 102 and display 104 and connected thereto via a wired or wireless data connection.

The system may also be monitored and/or controlled remotely using, for example, a laptop or second support console via a connection 160, such as a wired or wireless direct connection or a wired or wireless network connection to either the data acquisition module 130 or the on-site nozzle dam support console 100.

The nozzle dam support console 100 may also be adapted to automatically carry out corrective actions in certain circumstances (within appropriate limits), such as emergency shutdown of one or more seal region valves in the event of an air leak at a particular valve, automatic adjustment of the inlet air pressure, automatic adjustment of air pressure to a particular seal region, activation of a back-up air supply in the event of failure of the main air supply, or the like. In addition, the nozzle dam support console 100 may be adapted to keep a log of any such automatic corrective actions it has carried out, and this log may be displayed on the console display, printed out at an associated printer, or accessed remotely.

It should now be appreciated that the present invention provides advantageous embodiments of a nozzle dam assembly and methods for installing and removing such a nozzle dam assembly, as well as advantageous methods and apparatus for pressurizing and controlling nozzle dam seals.

Although the invention has been described in connection with various illustrated embodiments, numerous modifications and adaptations may be made thereto without departing from the spirit and scope of the invention as set forth in the claims.

What is claimed is:

1. An apparatus for watertight sealing of a steam generator nozzle, comprising:

an attachment ring adapted to be fitted in an interior of said nozzle, said attachment ring comprising:

a plurality of retaining tabs extending from an interior of said attachment ring towards a center of said attachment ring;

a plurality of receiving slots formed between said retaining tabs; and a nozzle dam landing formed in the interior of the attachment ring below the retaining tabs;

a nozzle dam adapted for insertion into said attachment ring and abutment against said nozzle dam landing, said nozzle dam comprising:

two top disc segments;

a plurality of radial protrusions extending from the two top disc segments of the nozzle dam and fixed with respect to the two top disc segments, said radial protrusions adapted to pass through said receiving slots of said attachment ring and directly interlock between and directly abut against said nozzle dam landing and said retaining tabs for fixing said nozzle dam in said attachment ring upon rotation of the nozzle dam in the attachment ring; and a seal covering at least a bottom side of the nozzle dam for effecting a watertight seal between the nozzle dam and the attachment ring.

2. An apparatus in accordance with claim 1, wherein the nozzle dam and seal form a nozzle dam assembly.

3. An apparatus in accordance with claim 2, wherein:

the seal forms a hinge connecting the two top disc segments, enabling the nozzle dam.

4. An apparatus in accordance with claim 3, further comprising:

a center locking mechanism for locking the two top disc segments together in an unfolded state of the nozzle dam.

5. An apparatus in accordance with claim 1, further comprising:

a rotation limiting mechanism provided on the nozzle dam to prevent over-rotation of the nozzle dam in the attachment ring.

6. An apparatus in accordance with claim 1, further comprising:

a locking mechanism for locking the nozzle dam into the attachment ring.

7. An apparatus in accordance with claim 6, wherein the locking mechanism comprises a locking pin or a locking tab.

8. An apparatus in accordance with claim 1, further comprising:

cladding fitted into the interior of said nozzle;

wherein said attachment ring is fixed in said cladding.

9. An apparatus in accordance with claim 1, wherein:

the attachment ring is machined from cladding provided in the interior of the nozzle.

10. An apparatus in accordance with claim 1, wherein the seal extends over the bottom side of the nozzle dam at over at least a portion of the nozzle dam edge.

11. An apparatus in accordance with claim 1, wherein the seal extends over the bottom side of the nozzle dam and beyond the edges of the nozzle dam.

12. An apparatus in accordance with claim 1, wherein the seal comprises an inflatable seal.

13. An apparatus in accordance with claim 12, wherein the seal is pressurized remotely after interlocking of said nozzle dam in said attachment ring.

14. An apparatus in accordance with claim 13, further comprising:

a computerized pressurization control and monitoring station for controlling and monitoring said remote pressurization of said seal.

15. An apparatus in accordance with claim 13, wherein said seal comprises a segmented seal having a diaphragm extending over the bottom side of the nozzle dam and pneumatic seals extending around a circumference of the nozzle dam.

16. An apparatus in accordance with claim 15, wherein two pneumatic seals are provided with an annulus arranged therebetween.

17. An apparatus in accordance with claim 15, wherein said segments of said seal are adapted to be pressurized and monitored independently by a pressurization control and monitoring station.

18. An apparatus in accordance with claim 15, wherein the diaphragm comprises a mechanical seal which is activated by flow of water.

* * * * *

UNITED STATES PATENT AND TRADEMARK OFFICE

CERTIFICATE OF CORRECTION

PATENT NO. : 8,019,038 B2
APPLICATION NO. : 11/985851
DATED : September 13, 2011
INVENTOR(S) : Evans et al.

It is certified that error appears in the above-identified patent and that said Letters Patent is hereby corrected as shown below:

Column 13, line 47: "enabling the nozzle dam." should read
--enabling the nozzle dam assembly to be folded in half.--

Signed and Sealed this
Eighth Day of November, 2011

David J. Kappos

David J. Kappos
*Director of the United States Patent and Trademark Office*